US005263601A

United States Patent [19]

Borow

[11] Patent Number: 5,263,601

[45] Date of Patent: Nov. 23, 1993

[54] CARGO CONTAINER

[75] Inventor: Henry Borow, Nuns Island, Canada

[73] Assignee: Transbor Systems, Inc., Canada

[21] Appl. No.: 933,242

[22] Filed: Aug. 21, 1992

Related U.S. Application Data

[63] Continuation of Ser. No. 587,050, Sep. 24, 1990, abandoned.

[30] Foreign Application Priority Data

Sep. 29, 1989 [CA] Canada ..... 614919

[51] Int. Cl.[5] ..... B65D 88/00

[52] U.S. Cl. ..... 220/6; 220/1.5

[58] Field of Search ..... 220/6, 1.5, 565, 562

[56] References Cited

U.S. PATENT DOCUMENTS

| | | | |
|---|---|---|---|
| Re. 22,876 | 5/1947 | Gray et al. | 114/74 |
| 1,194,680 | 8/1916 | Studebaker . | |
| 2,086,529 | 7/1937 | Bontemps | 296/44 |
| 2,107,400 | 2/1938 | Stabbal | 62/116 |
| 2,383,354 | 8/1945 | Teeter | 220/71 |
| 2,628,091 | 2/1953 | Rappl | 268/66 |
| 2,720,998 | 10/1955 | Potter | 220/6 |
| 2,887,243 | 5/1959 | Murdock, Sr. | 220/8 |
| 2,952,379 | 9/1960 | Potter | 220/6 |
| 3,084,825 | 4/1963 | Hultquist | 220/8 |
| 3,130,850 | 4/1964 | Oakey et al. | 220/6 |
| 3,191,793 | 6/1965 | Morrison | 220/9 |
| 3,300,900 | 1/1967 | Risk et al. | 49/381 |
| 3,344,831 | 10/1967 | Brackett | 150/0.5 |
| 3,570,705 | 3/1971 | Kassravi | 220/63 |
| 3,658,205 | 4/1972 | Kassravi | 220/63 R |
| 3,752,354 | 8/1973 | Demirag | 296/44 |
| 3,868,042 | 2/1975 | Bodenheimer | 220/63 R |
| 4,163,505 | 8/1979 | Gunther | 220/85 B |
| 4,177,907 | 12/1979 | Funaioli et al. | 220/1.5 |
| 4,231,481 | 11/1980 | Nash et al. | 220/1.5 |
| 4,365,442 | 12/1982 | Speer | 49/346 |
| 4,453,875 | 6/1984 | Johnson, Sr. | 414/304 |
| 4,497,259 | 2/1985 | Titterton | 105/359 |
| 4,557,400 | 12/1985 | Clarke | 222/105 |
| 4,613,053 | 9/1986 | Kimura et al. | 220/22 |
| 4,678,389 | 7/1987 | Bonerb | 114/267 |
| 4,735,457 | 4/1988 | Bonerb et al. | 298/27 |
| 4,863,339 | 9/1989 | Krein | 414/786 |
| 4,901,885 | 2/1990 | Boots | 220/402 |
| 4,911,317 | 3/1990 | Schloesser et al. | 220/1.5 |
| 4,966,310 | 10/1990 | Hawkins | 222/105 |
| 5,054,223 | 10/1977 | Marques | 220/4 F |

FOREIGN PATENT DOCUMENTS

| | | |
|---|---|---|
| 611616 | 1/1961 | Canada . |
| 772502 | 11/1967 | Canada . |
| 919103 | 1/1973 | Canada . |
| 1065777 | 11/1979 | Canada . |

(List continued on next page.)

*Primary Examiner*—Steven M. Pollard
*Attorney, Agent, or Firm*—Samuel Meerkreebs

[57] ABSTRACT

A cargo container is adapted to transport liquids and, alternatively, solid cargo which comprises a box-like housing having rigid side walls and an expansible vessel for containing the liquids mounted inside the box housing. The expansible vessels include a rigid fixed bottom wall, a rigid top wall extending parallel to the bottom wall, and a flexible impermeable sleeve forming side walls extending between the vessel bottom wall and the top wall. The top wall is adapted for movement within the box housing between a retracted position and an expanded position and to be raised by air pressure. Latches are provided to secure the vessel top wall in the expanded position to the box housing side walls, whereby the vessel can be filled with liquids. When in the retracted position, the top wall is close to the bottom wall with spacers on the bottom wall to support the top wall in the retracted position and to thus define a dead space to receive the retracted sleeve. There are cable and pulley devices for providing parallelism to the top wall when the vessel is being expanded and retracted. The box housing side walls include hinged lid panels adapted to be folded down onto the top wall of the expansible vessel when the expansible vessel is retracted in order to serve as a floor for the solid bulk cargo.

34 Claims, 11 Drawing Sheets

U.S. PATENT DOCUMENTS

| | | |
|---|---|---|
| 1197796 | 12/1985 | Canada . |
| 0331491 | 9/1989 | European Pat. Off. . |
| 469237 | 12/1928 | Fed. Rep. of Germany . |
| 1905724 | 9/1969 | Fed. Rep. of Germany . |
| 2246150 | 4/1974 | Fed. Rep. of Germany . |
| 2458312 | 7/1976 | Fed. Rep. of Germany . |
| 3631745 | 4/1988 | Fed. Rep. of Germany . |
| 828364 | 2/1938 | France . |
| 7602555 | 9/1977 | Netherlands . |
| 620336 | 3/1949 | United Kingdom . |
| 832409 | 4/1960 | United Kingdom . |
| 943661 | 12/1963 | United Kingdom . |
| 1032656 | 6/1966 | United Kingdom . |
| 1078957 | 8/1967 | United Kingdom . |
| 1293750 | 10/1972 | United Kingdom . |
| 2201712 | 9/1988 | United Kingdom . |

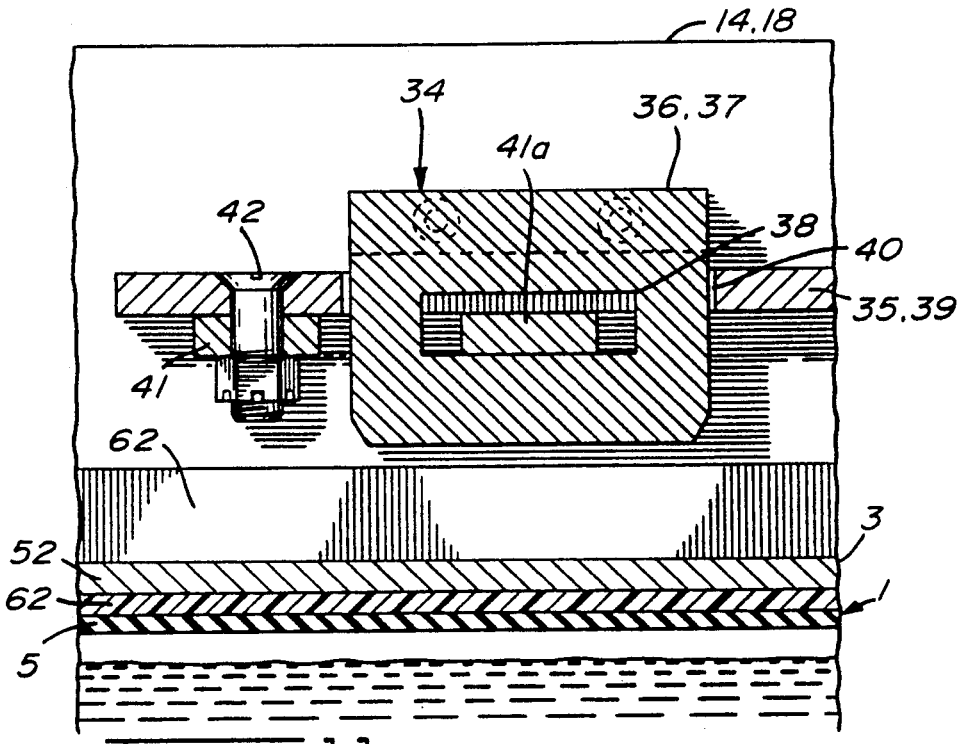
FIG. 11
FIG. 12
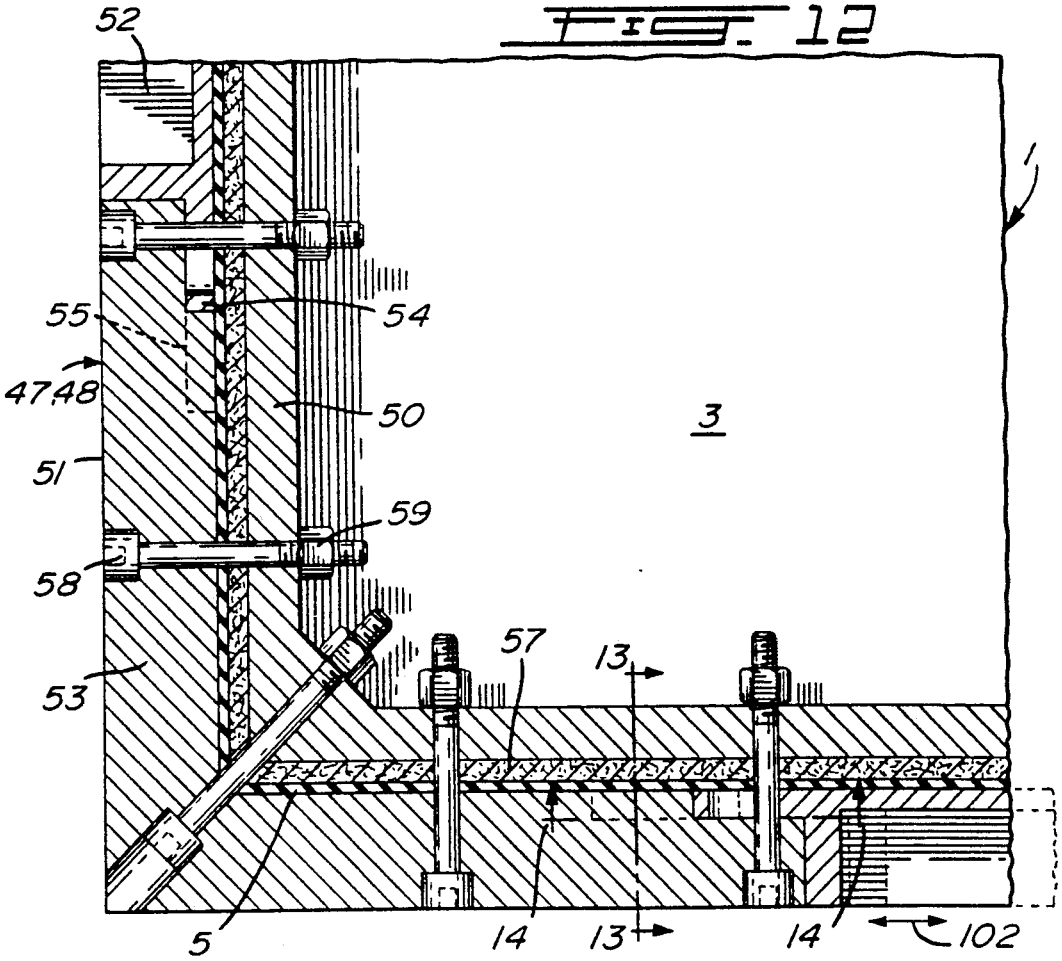

10
V
72
66
77
14,18
76
71
75
68,69
68
67
65
73
70
108b
108c
69
17
74
108a
15
20
28
29
30
31

CARGO CONTAINER

This application is a continuation of Ser. No. 07/587,050 filed Sep. 24, 1990, copending, but now abandoned in favor of the present application.

BACKGROUND OF THE INVENTION

1. Field of the Invention

The present invention relates to cargo containers and, more particularly, to expansible containers.

2. Description of the Prior Art

Liquids are normally transported in bulk and, where the use of a pipe line is impractical, they are conveyed in vehicles, railcars, aircrafts, or ships fitted with rigid tanks. One of the major factors contributing to the expense of transporting liquids in bulk in such specially constructed tankers is that, once having delivered their loads, whether by sea, air, road, or rail, they must usually make the return trip empty.

Therefore, expansible cargo containers capable of carrying alternatively liquid cargo or solid cargo were developed. U.S. Pat. No. 3,570,705 issued on Mar. 16, 1971 to Kassravi discloses such a cargo container which comprises a rigid walled structure within which there is provided a movable platform. A flexible corrugated sleeve is sealingly connected along its periphery to the platform and to a fixed rigid floor wall of the container to form an expansible vessel. The rigid walls support the sleeve against internal pressure from the liquids provided in the vessel and protect it from external damaging influences.

Therefore, supplying liquid in the expansible vessel causes the platform to displace vertically upwards with the platform retaining a substantial horizontality as being supported by the level liquid. The upwards movement of the platform is limited by inwardly projecting brackets provided at the top of the rigid walled structure. When the expansible vessel is empty of liquids, the platform is in a retracted position within the walled structure. A solid cargo receiving box-like structure is thus formed.

SUMMARY OF THE INVENTION

It is therefore an aim of the present invention to provide an improved expansible cargo container capable of carrying alternatively liquid cargo or solid cargo.

It is also an aim of the present invention to provide a cargo container which is of modular construction in order that it may be mounted, for instance, on a flat bed or in a semitrailer.

It is a further aim of the present invention to provide a cargo container including an expansible vessel having a top wall which is raised by air pressure.

It is still a further aim of the present invention to provide a cargo container in which the expansible vessel has flexible impermeable side walls made from a flat sheet material.

In accordance with the present invention, there is provided a cargo container adapted to transport liquids and, alternatively, solid cargo, comprising a box-like housing having rigid side walls and an expansible vessel adapted for receiving and containing the liquids mounted inside the box-like housing. The vessel includes a rigid bottom wall, a rigid top wall extending parallel to the bottom wall, and flexible impermeable side walls extending between the vessel bottom wall and top wall. The top wall is adapted for movement within the box-like housing between a retracted position where the top wall is adjacent to the bottom wall with the vessel side walls collapsed therebetween and an expanded position. Means are provided for maintaining the vessel top wall substantially parallel to the vessel bottom wall when the vessel is vertically displaced. Means are provided to prevent the vessel side walls from penetrating into gaps defined between the vessel top wall and the rigid side walls. The vessel is adapted to receive air therein for raising the vessel top wall to the expanded position. Means are provided for securing the vessel top wall in the expanded position to the box-like housing.

In a more specific construction, a sleeve made from a flat sheet material forms the vessel side walls.

In a still more specific construction, the rigid side walls of the box housing include panels adapted to be folded down onto the top wall when the expansible vessel is retracted in order to serve as a floor for solid bulk cargo.

More specifically, the vessel includes peripheral top flanges mounted on the top wall to sealingly engage the top edges of the flexible walls, and peripheral bottom flanges are provided on the bottom wall of the vessel for sealingly engaging the bottom edges of the flexible walls. The expansible vessel may be provided with a heat exchanger for heating or cooling the contents of the vessel, and a vent may be provided to allow the passage of air or gases but not liquids. A port is also provided for loading and unloading liquids into the expansible vessel.

The panels of the rigid side walls can pivot by way of hinge means which are located slightly above an upper surface of the vessel top wall when retracted. The pivoting panels are adapted to pivot at least between an open upstanding position for allowing the vessel to be expanded and a folded horizontal position in which the panels overlie one and another and the vessel top wall. The panels and the hinges are adapted to provide a continuous plane inner surface to the box housing when the panels are in their upstanding position in order that the vessel side walls can come in continuous contact therewith without any grooves or protrusions thereunder into which the vessel side walls could become wedged under the force exerted by the liquid in the vessel. Also, the pressure could cause the vessel side walls to split open. Similarly, the panels and hinge means are adapted, in the folded position of the panels, to provide a plane continuous upper surface onto which the solid bulk cargo can be carried. This prevents solid cargo from wedging into the hinges and possibly damage the same when the panels are moved towards their upstanding position.

In a particular construction, all four side walls of the box housing include hinged panels, with the height of a pair of opposite panels being sufficient in order to at least join one another, if not overlap each other when they are folded so as to provide a continuous solid cargo receiving floor. Alternatively, only one or two of these side walls may be provided with hinged panels.

Power cylinders and lever mechanisms may be used to actuate the panels between their open and closed positions.

When hinged panels are provided on the box housing, a rigid pale defines the portion of the box housing located lower than the panels and on which the hinges are secured.

The means for maintaining the top wall in its expanded position can comprise a series of latches having cooperating parts provided on the upper surface of the top wall near the periphery thereof and on the inner upper portions of the rigid side walls of the box housing and, more particularly, of the panels thereof.

In order to prevent the box housing from deforming or yielding under the pressure exerted by the expansible vessel when the platform is being displaced vertically, straps may be provided which extend from the upper free ends of opposite pairs of panels thereby limiting the outwards pivot of the panels to their aforementioned upstanding position.

The vessel side walls may be made of a single sleeve which is made from a straight, flat and uncorrugated sheet of flexible impermeable material.

Limiting means may be provided on the inner upper portions of the panels to limit the upwards movement of the top wall when the vessel is being expanded. These limiting means may further be integral to the parts of the latches mounted on the panels, whereby, when the top wall reaches the limiting means, it is in position to be connected to the panels by way of the latches.

Arresting floating brackets may be provided along the periphery of the top wall as the means to prevent the sleeve from inserting or wedging into the gaps defined between the top wall and the panels. As the parallelism system might not maintain the vessel top wall completely parallel to the vessel bottom wall, it is possible that the vessel top wall will tilt slightly, thereby accentuating the gaps formed between the vessel top wall and the panels. However, the arresting brackets are adapted to also close off such larger gaps.

The vessel top wall in an expansible vessel can be moved up and down by means of a liquid or by air depending on the construction of the container. In all cases, the liquid or air pressure which act upwards on the vessel top wall to raise it applies at the same time an internal pressure against the four side walls of the sleeve thereby pressing the same against the rigid walls of the box housing. The sleeve thus has to displace upwards while being in contact with the rigid side walls which results in friction. To overcome this friction, more pressure is required which consequently develops more friction, and so on up to a point where the sleeve becomes jammed.

In U.S. Pat. No. 3,658,205, the vessel top wall is raised by liquid pressure and the pressure applied against the rigid side walls is much higher than that of air. For example, for a vessel having a 50 inch height, the mean pressure on the vessel side walls will be approximately 10 times higher with water than with air. In order to reduce the friction between the sleeve and the rigid side walls, a corrugated sleeve is used to reduce the contact surfaces between the sleeve and the rigid side walls and therefore the amount of friction. The vessel top wall in this patent is directly supported by the liquid, whereby the horizontality of the vessel top wall is substantially ensured by the liquid which remains level. This allows the vessel top wall to basically remain horizontal during its vertical displacements. On the other hand, the vehicle on which the cargo container is mounted has to be level in order that the vessel top wall remains at right angles to the rigid side walls. Indeed, if the vehicle is slightly angled because of the parking surface, the rigid side walls are also angled with respect to the vertical whereas the vessel top wall remains substantially horizontal as it overlies the liquid which remains level because of the gravity forces providing there is an even distribution of weight and of friction. In such a case, the vessel top wall will most likely jam as it is being displaced vertically within the box housing.

Furthermore, when the vessel top wall is raised by liquid pressure, it is extremely difficult or even impossible to lock and unlock the vessel top wall to the box housing by way of the latches as it is difficult to stop the vessel top wall precisely at a position where the latches can be engaged in view of the incompressibility of the liquid. Moreover, high liquid pressures from a pump during loading of the vessel can cause the container to burst if for one reason or another the pumping of the liquid therein is not stopped on time.

Again, an almost completely horizontal parking surface is required for engaging the latches, which is extremely rare. Indeed, if the parking surface is not level, . the vessel top wall which remains horizontal as overlying the liquid will not be aligned with the rigid side walls at identical heights thereof.

The above U.S. patent cannot use air to raise or lower the vessel top wall as air pressure which is lower than liquid pressure will allow for various tilts of the vessel top wall which will result in the vessel top wall becoming jammed within the box housing as the sleeve becomes pinged in the gaps which are not blocked by devices such as the present arresting brackets.

In the present invention, a parallelism means is provided in order to ensure that the vessel top wall remains substantially parallel to the vessel bottom wall and thus perpendicular to the rigid side walls even if the parking surface is not level. The arresting brackets are provided to close the gaps. On a level surface, the vessel top wall can be raised or lowered either by way of a liquid or by air pressure. In case of a liquid, a corrugated sleeve is required for the reasons mentioned hereinabove regarding friction forces. On the other hand, air pressure to raise or lower the vessel top wall can be used whatever the orientation of the cargo container. It is noted that since U.S. Pat. No. 3,658,205 is not provided with a parallelism system to ensure that the vessel top wall remains parallel to the vessel bottom wall, the vessel top wall cannot be displaced up and down by air pressure. With such a parallelism system and the arresting brackets, the above U.S. patent could work using air pressure. However, it would remain quite expensive because of the corrugated sleeve which is complicated to make.

If the vessel top wall is to be displaced by air pressure in the present invention, the corrugated sleeve has to be replaced by a sleeve made of a flat sheet material. If such a flat sheet is provided, liquids cannot be used to move the vessel top wall because of the high pressure thereof which develops high friction forces between the sleeve and the rigid side walls, as explained hereinbefore. Therefore, if a parallelism system and arresting brackets are provided, air can be used to displace the vessel top wall thereby allowing the use of an inexpensive sleeve made of a flat sheet material.

In such a construction, the air pressure required to move the vessel top wall is relatively low in the range of a few inches water column. Because of the compressibility of air, it becomes relatively easy to move the vessel top wall up and down in order to lock and unlock the latches. A pressure blower of say twelve inches water column is sufficient to engage the male and female parts of the latches. The use of air for raising the vessel top wall results in the advantage that the vessel top wall can be fixed to the box housing rigid side walls by way of the locking latches before starting to load the liquid in the vessel. This reduces the pressure on the top straps and therefore prevents bulging of the rigid side walls as the rigidity of the structure formed by the vessel top wall latched to the box rigid side walls can withstand more pressure than the straps alone. The straps are sufficient for maintaining the box housing rigid side walls in a vertical position under air pressure but the lock latches are necessary when the box housing side walls become pressurized by the liquid and especially under the dynamic forces encountered during transportation of the container. Furthermore, if something happens during the ascension of the vessel top wall under liquid pressure, the liquid must be completely emptied from the vessel, for instance, to repair the cargo container. Facilities to empty the vessel of the liquid pumped therein are not always available.

Again, the horizontal stability of the vessel top wall moved by air pressure is very poor and the slightest friction at any point results in the tilting of the vessel top wall. Therefore, using air pressure, a parallelism system and arresting brackets are essential.

In general, sleeves are made of a fabric (canvas) coated on one or two sides with layer or layers of rubber. A green rubber or green sleeve represents uncured rubber which thus do not have any resiliency or strength. A green sleeve can be cut and formed to any desired shape or form. In the ensuing curing process, the green sleeve is located between two rigid surfaces and high pressures and high temperatures are applied at the same time on the two sides of the sleeve for a certain period of time. The process is relatively simple when a flat sheet must be cured as the sheet is passed between two sets of heating rolls. Once the rubber has been cured, it cannot be easily formed or shaped or spliced.

The corrugated sleeve of U.S. Pat. No. 3,658,205 necessitates the use of uncured rubber which can only be cured after the formation of the pocket corners. In order to cure a container size and shape sleeve having pocket corners and corrugated pleats, two rigid molds must be fabricated: an inner and an outer mold. For example, for curing a sleeve which is eight foot wide by six feet high and twenty feet long, two molds of 8 feet by 6 feet by 20 feet must be built and a system must be provided to apply equal pressure and temperature throughout the entire sleeve. The molds must take into consideration the pleat noses and pocket corners whereby the process becomes especially complicated.

Indeed, the above U.S. patent must use uncured rubber and not a flat sheet because of the necessity of having a pre-pleated corrugated sleeve. Again, such corrugations are necessary to reduce the friction between the sleeve and the rigid side walls since liquid is used as a moving agent. By using corrugations, only the pleat noses are in contact with the rigid walls, hence the friction forces are reduced.

In the present invention, the presence of the parallelism system prevents considerable tiltings of the top vessel wall and therefore the creation of larger gaps which could not be closed by the adjustable arresting brackets and into which the sleeve could thus penetrate. The provision of arresting brackets prevents the sleeve to be pushed into a range of smaller gaps defined between the top vessel wall and the rigid side walls. The parallelism system and the arresting brackets thus allow air to be used for vertically moving the vessel top wall. By using air as a moving agent, the internal pressures applied on the sleeve are reduced, whereby a sleeve made from a flat sheet material can be used instead of a corrugated sheet. Furthermore, as a consequence of using air as the motor force, a latch system as described hereinabove can be used for securing the top vessel wall in its expanded position to the box housing rigid side walls. The above U.S. patents cannot use such a latch system as liquid is used to raise the vessel top wall in view of the reasons presented hereinbefore.

The advantage of using a flat sheet for manufacturing the sleeve resides in that a standard readily available and inexpensive material which is fabricated and precured by standard existing techniques and methods can be used. Only the splicing or joining of two flat ends is required. This is achieved by pressing the two overlapping ends while applying heat.

The corrugated and pleated sleeve of the above U.S. patent is complicated and difficult or even impossible to manufacture as it requires large and complicated molds. The molds are very expensive ($40,000.00). Furthermore, a twenty foot long corrugated sleeve would cost about $25,000.00 versus $1,000.00 for a sleeve made from a flat sheet material, as in the present invention. It is therefore considered that the corrugated system would be uneconomical to use in transportation.

Furthermore, the corrugated sleeve has an uneven thickness and therefore weak spots especially at the corners. There are discontinuities in the material and no technique is known to fabricate a proper corrugated sleeve. During operation, there is a possibility of the corrugated sleeve cracking at the pleats thereof when the sleeve is stretched to its full height. The stretching of the pleats produces compression on the outer surface of the corrugated sleeve and tension on the inside surface thereof. This problem is accentuated by the small thickness of the material. Therefore, there is a quite high danger of the sleeve cracking which would result in liquid leaking outside of the cargo container and the vehicle carrying it.

Improvements and advantages of the present invention are presented hereinbelow.

The present invention provides a cargo container which is fully autonomous, self-sufficient, and portable, requiring only an external receiving floor. The cargo container which can include a full rigid floor for additional rigidity and strength is adapted to be anchored to a vehicle floor.

The lid system which includes the side wall panels of the box housing reduces the weight and cost of the expansible containers because the lid panels are used as structural members as well as rigid walls and as a false floor, thus eliminating duplication of the structural members.

The lid system makes possible an unobstructed original space when the panels are closed or lowered and solid cargo is transported. The space is at a premium when transporting solid cargo.

The lid system allows for the provision on the inside of the panels of various straps and protruding latches which become hidden underneath the panels when they are closed in order not to interfere with the solid cargo.

The lid system eliminates cantilever hanging of the false floor around its periphery and makes the false floor more rigid and stronger. Without these panels, the top wall is used as a false floor supported only centrally and hanging in a cantilever fashion around its periphery.

The lid system with its hinges and overlapping panel arrangement seals the inside of the closed container from the outside and thus reduces penetration of foreign material into the vessel space which can cause damage to the sleeve.

The lid system is assisted by the panel actuator system. Without the actuator system, it can be difficult to open and close the panels.

The expansible container is composed of two separate main parts, i.e. the box housing and the vessel, and consequently each part can be manufactured separately. Furthermore the expansible vessel can be easily removed for access, inspection, and maintenance.

The peripheral sealing flanges capable of providing a fluid-tight seal of the horizontal surfaces located in different planes, the parallel system preventing the vessel top wall from tilting thereby reducing the necessary gaps or clearances between the top wall and the rigid side walls, and the arresting floating brackets sealing the gaps all render possible the use of a standard, readily available, inexpensive, precured flat sheet material that is fabricated and cured by standard and existing techniques and methods. This eliminates the need for the sleeve to be molded or formed from uncured sheets with a series of corrugations and pleats that can extend in concertina-like fashion and cured thereafter with molds, high pressures and temperatures to form the pocket corners. Also, there is no more need for reinforcing strips and tie belts. Pre-forming of corrugations and pleats requires the use of uncured rubber, complicated molding, and curing technology and equipment. The sleeve must be molded into a pleated position to somehow retain a "memory" that ensures its return to the pleated position after having been stretched. The finished sleeve material usually has uneven thickness. This occurs especially at corners. Unevenness and discontinuity of material increase the possibility of liquid leaks. There is a possibility of cracking at pleat areas when it is stretched to full height. The stretched pleat produces compression on the outer surface of the sleeve and tension on the inside surface. This problem is accentuated by the small thickness of material. The present invention results in considerable savings as such sleeves molded or formed with corrugations and pocket corners are expensive to manufacture.

The parallel system, the arresting floating brackets, and the flat unpleated sleeve make possible a vertical movement of the vessel top wall by air instead of by liquid. The top wall is kept in a parallel, horizontal position, and the sleeve cannot penetrate into the gaps between the top wall and the panels because of the arresting floating brackets. The air pressure necessary to operate the top wall is much lower than the pressure required by liquids. Consequently, there is less friction between the sleeve material and the panels. Lower friction permits the use of a flat unpleated sleeve instead of a precorrugated sleeve. The top wall can be moved to its upper position and locked in place by latches while empty, and only after a strong and rigid all-sides container is created, can the loading of liquid start. The same container can be unloaded of its liquid while the top wall is in its upper position. It is safer and more reliable to move the top wall up and down without liquid inside the vessel and without high liquid pressure inside the container.

BRIEF DESCRIPTION OF THE DRAWINGS

Having thus generally described the nature of the invention, reference will now be made to the accompanying drawings, showing by way of illustration a preferred embodiment thereof, and in which:

FIG. 11 is a cross-sectional view taken along lines 11—11 of FIG. 9;

FIG. 12 is a cross-sectional plan view of a corner of the top peripheral flange;

DESCRIPTION OF THE PREFERRED EMBODIMENTS

Reference will now be made to the drawings which illustrate a preferred construction of an expansible cargo container C in accordance with the present invention.

Figure 1:
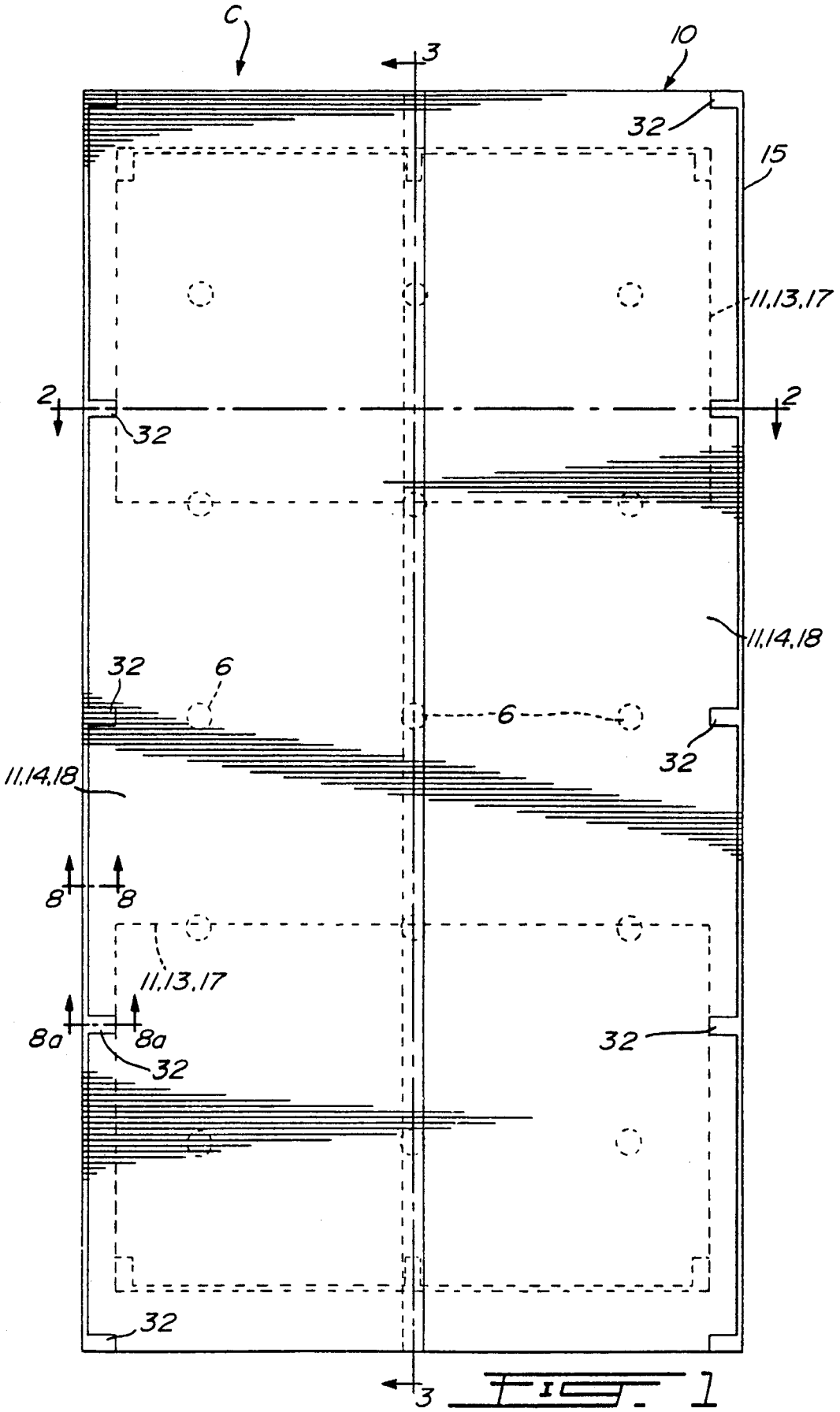
FIG. 1 is a top plan view of an expansible cargo container in accordance with the present invention in a folded and closed position thereof.
Figure 5:
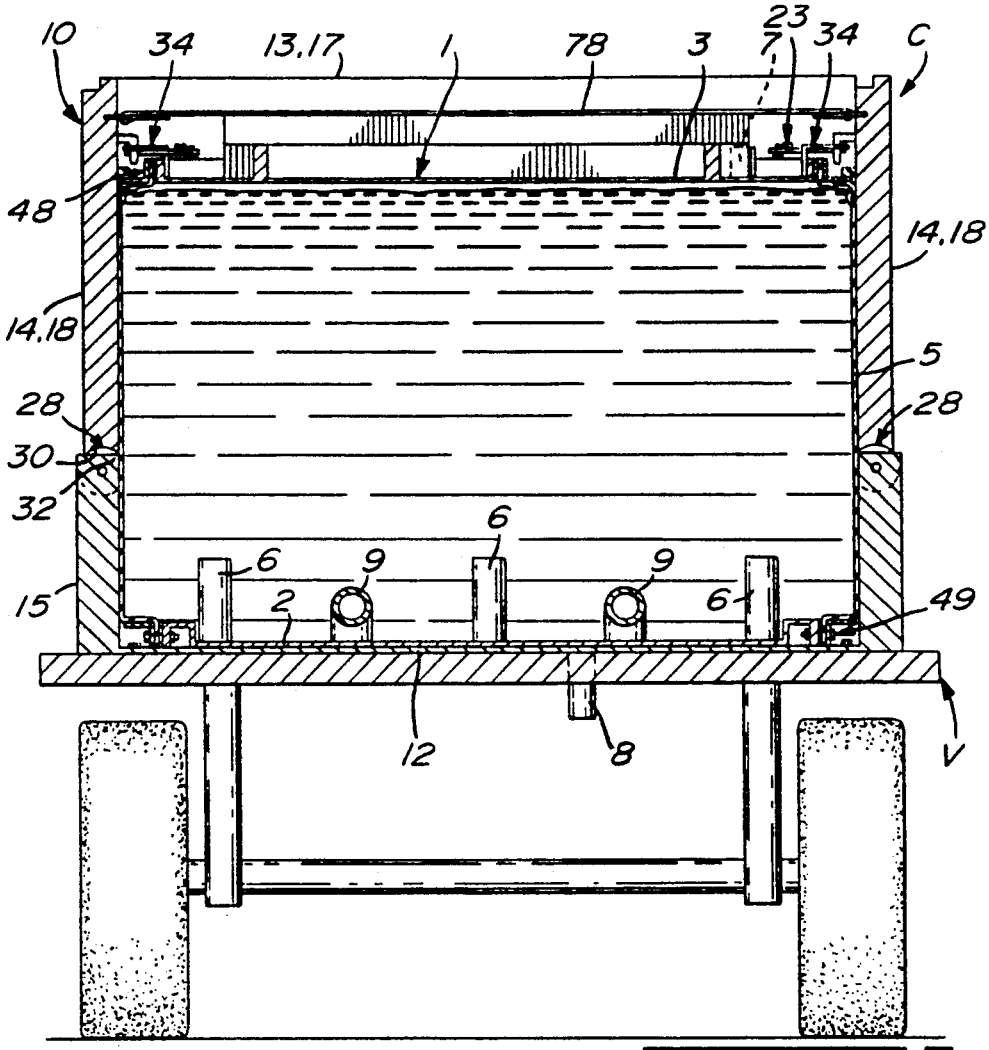
FIG. 5 is a cross-sectional side view taken along lines 5—5 of FIG. 4.

FIGS. 1 and 5, for instance, show an expansible, fluid-tight vessel 1 which includes a rigid base 2 and an upper rigid wall or platform 3. A flexible sleeve 5 which will be further described hereinbelow extends between the platform 3 and the rigid base 2 to form the side walls of the vessel 1. The platform 3 is movable vertically between its lower position which is relatively close to the base and outer or upper position which is further spaced from the base 2. The platform 3 can be lifted upwards by compressed air supplied by a fan or a blower (not shown) through a vent opening 7. The platform 3 will move downwardly by gravity, and the rate of descent can be controlled by the vent opening 7. The positive pressure inside the vessel 1 during the platform descent presses the sleeve walls 5 against the rigid walls (to be described later), thus creating conditions which allow for proper and gentle folding of the flexible sleeve material 5.

Figure 4:
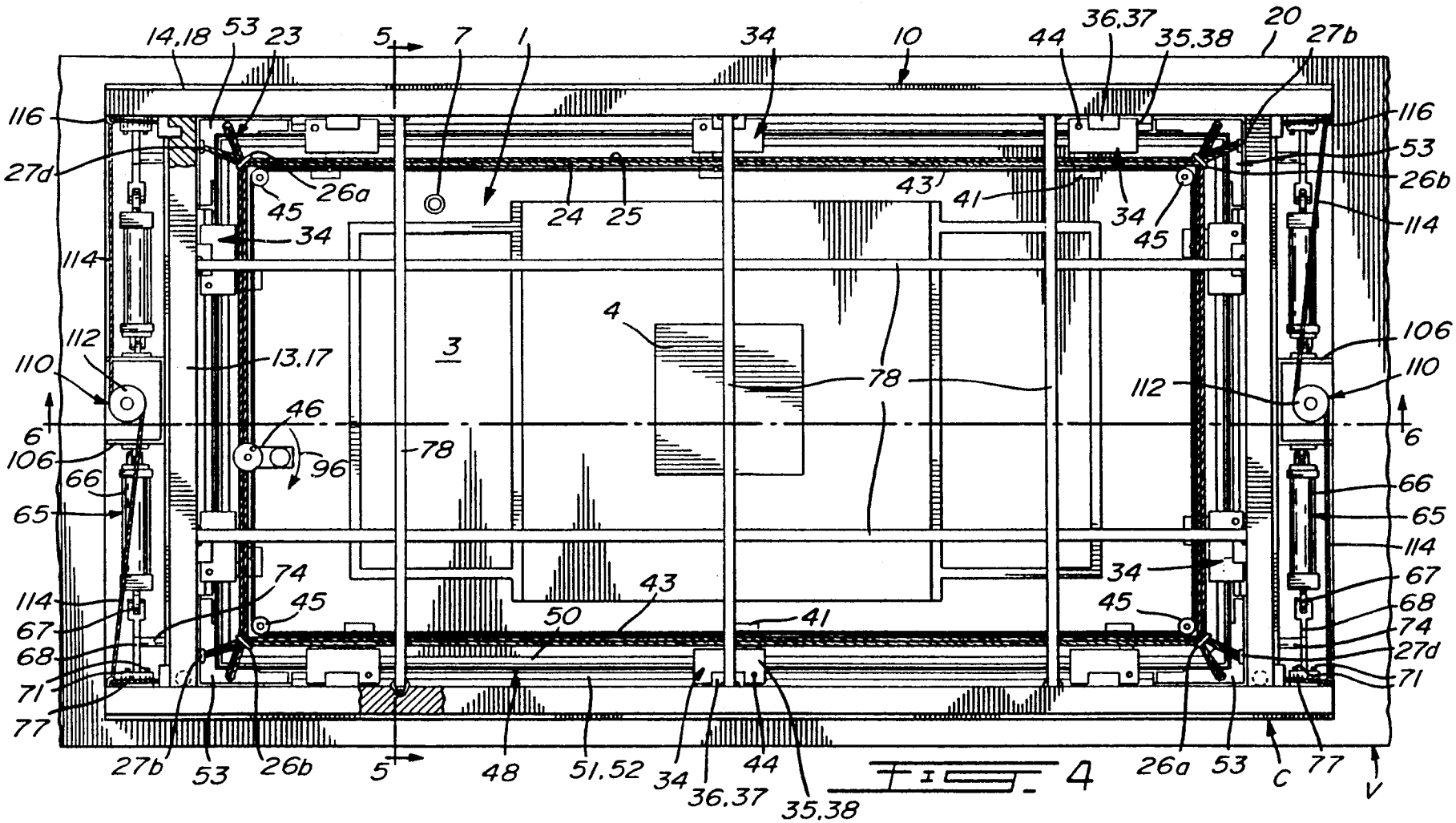
FIG. 4 is a top plan view of the expansible cargo container in accordance with the present invention in its expanded and opened position.

A manhole 4, as shown in FIG. 4, can be provided in the platform 3 for allowing access to the vessel 1.

The sleeve 5 constitutes a continuous flexible wall. In the case of a circular vessel, the wall would be a cylinder, while in the case of a square or rectangular vessel, the sleeve 5 will adopt that configuration. The sleeve 5 is made from a straight, flat, and uncorrugated sheet of flexible material chosen to suit the liquid that it is intended to transport. Thus, if, for example, the vessel 1 is intended to carry oil, the flexible sleeve 5 would be made of oil-resisting rubber. Alternatively, the sleeve 5 can be made of rubber having a flexible reinforcement or of a flexible plastics material. The advantage is that the straight and flat standard sheet material can be used, and consequently, pre-cured rubber can be used requiring splicing only. Thus, the need for expensive and complicated molds and curing equipment for forming a corrugated sleeve is eliminated. The sheets can be produced by standard methods without any modification to existing equipment and procedure.

Spacers or pillars 6 are welded to the base 2 or to the underside of the platform 3 and can be of any cross-section. If the pillars 6 extend from the underside of the platform 3, it becomes easier to clean the bottom of the vessel 1. The pillars 6 are distributed regularly over the central part of the base 2. The top ends of the pillars 6 can be fitted with rubber pads (not shown). The pads eliminate metal-to-metal contact between the platform 3 and the base 2 in the retracted position of the platform 3, and also absorb shocks and minimize vibration of the platform 3 when a vehicle V onto which is mounted the container C is in motion. In the drawings, the vehicle V which is illustrated represents a flat bed. The container C could also be mounted in a semitrailer. The rubber pads thus support the platform 3 on top of pillars 6. The pillars 6 create a dead space between the platform 3 and the base 2 in which the sleeve 5 can fold freely when the platform 3 is in its retracted position. The pillars 6 transfer platform load to the base 2 and further to the floor of the vehicle V. The dead space permits the sleeve 5 to be packed away and folded beneath the platform 3 when the platform 3 is in its retracted position.

As previously mentioned, an air vent 7 is provided in the platform 3 and serves to allow air, vapor, or any gases to pass inwardly and outwardly of the vessel 1.

A liquid opening 8 is provided in the base and serves to allow liquid to be pumped in or out of the vessel 1. By having the liquid opening 8 in the base 2, bottom filling and unloading can be provided.

A heat exchanger 9 is also shown as being located within the vessel 1, and this provides heating or cooling of the liquid. The heat exchanger 9 can be a coil or any other type of known heating or cooling element. An external heat exchanger located exteriorly of the vessel, such as beneath the base 2, can also be provided.

FIGS. 1 to 7 show the box housing 10 which will be referred to as the rigid box 10 in the following description. Thus, the rigid box 10 has a rigid cylindrical wall in the case of a circular box and four rigid walls 11 in the case of a square or rectangular box, as in the drawings. The box 10 supports the sleeve 5 against pressure within the vessel 1, protecting the sleeve 5 against external damage, and the walls of the box 10 also serve to guide the platform 3 in its vertical movements between the expanded and retracted positions. The box 10 also allows the platform 3 to be locked in its upper expanded position as it will be described hereinafter. The walls 11 have smooth inner surfaces to minimize the possibility of the sleeve 5 being punctured or damaged. The box 10 includes a full bottom wall 12, as seen in FIGS. 2, 3, 5, 6 and 15. Alternatively, only a partial bottom wall 12*a* can be provided to the box 10 (see FIG. 7). The walls 11 include a pair of end walls 13 and a pair of side walls 14.

A pale 15 forms the bottom portion of the box 10 and includes four fixed side walls terminating at hinges 28. The remainder of the rigid side walls 14 above the hinges 28 are in the form of pivoting side lid panels 18, while the end walls 13 include end lid panels 17. Each of the lid panels 17 and 18 are rigid panels which form part of the box 10. The hinges 28, which will be described further, allow the lid panels 17 and 18 to be in vertical planes forming the walls 13 and 14 respectively, or the lid panels 17 and 18 can be folded over each other, as shown in FIGS. 1, 2 and 3, thereby forming a false floor of the cargo container C when the expansible vessel 1 is in a retracted position.

Figure 2:
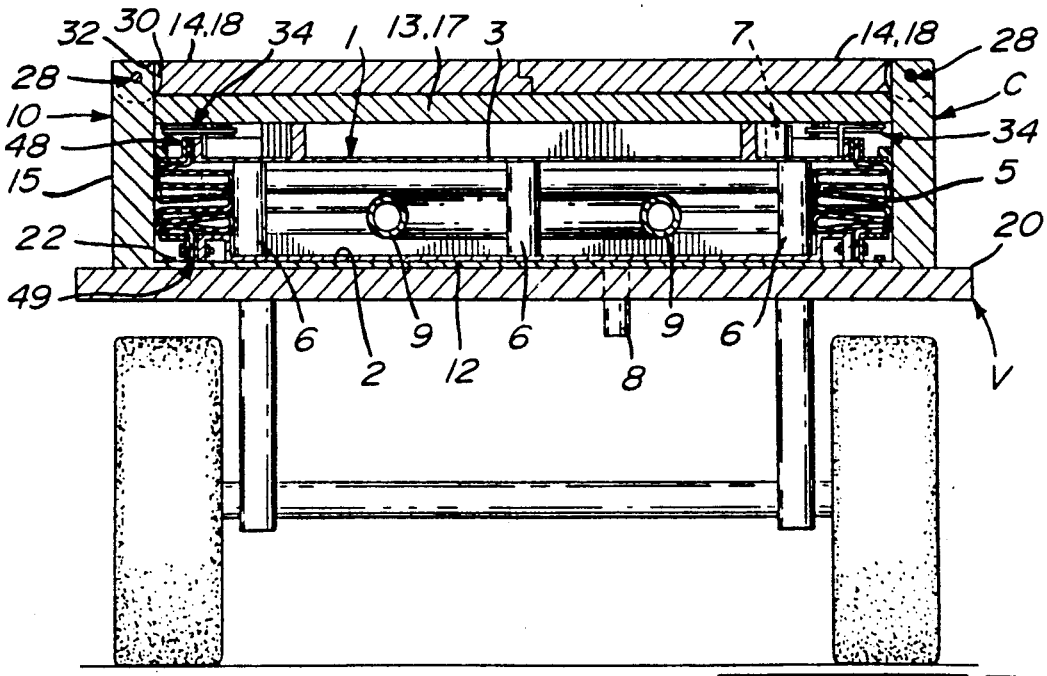
FIG. 2 is a cross-sectional side view taken along lines 2—2 of FIG. 1.
Figure 3:
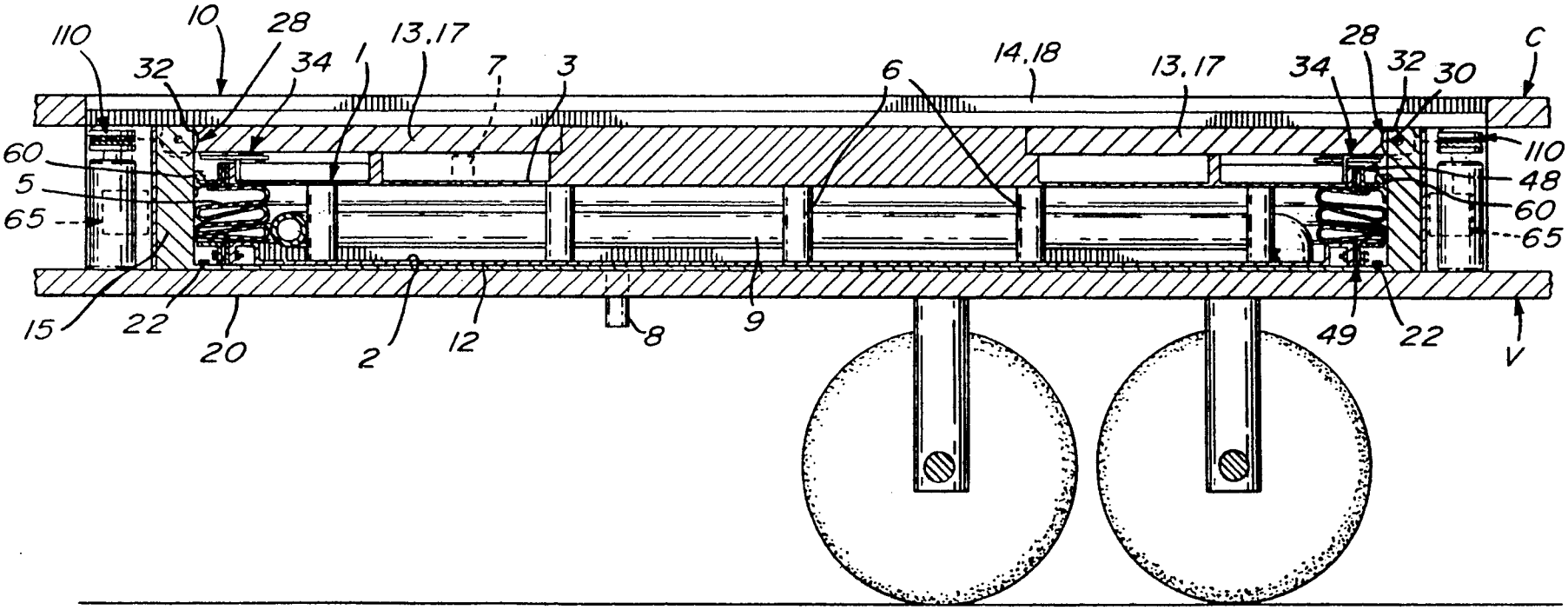
FIG. 3 is a cross-sectional elevation taken along lines 3—3 of FIG. 1.

The end lid panels 17 are first folded over onto the platform 3, and the side lids 18 are folded over onto the end lid panels 17, with the edges of the side lid panels 18 overlapping each other, as shown in FIG. 2. The end lid panels 17 may be actuated manually by means of a winch or other power mechanism (not shown). The side lid panels 18 will normally be actuated by power means, as will be described later.

The container C which is suitable for being located on a truck bed or vehicle V is the combination of the box 10 and the expansible vessel 1. The container C, therefore, is an autonomous unit which is capable of carrying a liquid within the vessel or solid cargo on the top of the folded-over lid panels 17 and 18. A receiving floor 20 must be strong enough to withstand the load and weight of the container C and its cargo. The floor 20 may be a truck bed V or the bed on the interior of a closed truck box. The floor 20 of the vehicle V, as shown in FIG. 2, is adapted to receive the expansible container C. The floor 20, in the present illustrated case, is mounted on the truck body V. Of course, the expansible container C can be loaded within a shipping container, a railroad car, an airplane, a sea ship, or any form of storage facility. Also, more than one expansible container C can be mounted on the same receiving floor. A fastening system 22 passing through the bottom wall 12 (or 12*a*) can be provided to secure the expansible container C on the truck bed V. If the container C only includes the partial bottom wall 12*a* of FIG. 7, then the expansible vessel 1 and, more particularly, the base 2 thereof directly overlies the floor 20 of the vehicle V.

It is easy to remove the vessel 1 of the box 10 simply by removing one of the end walls 13 including its respective pale wall and by then sliding the vessel 1 out of the box 10.

Figure 7:
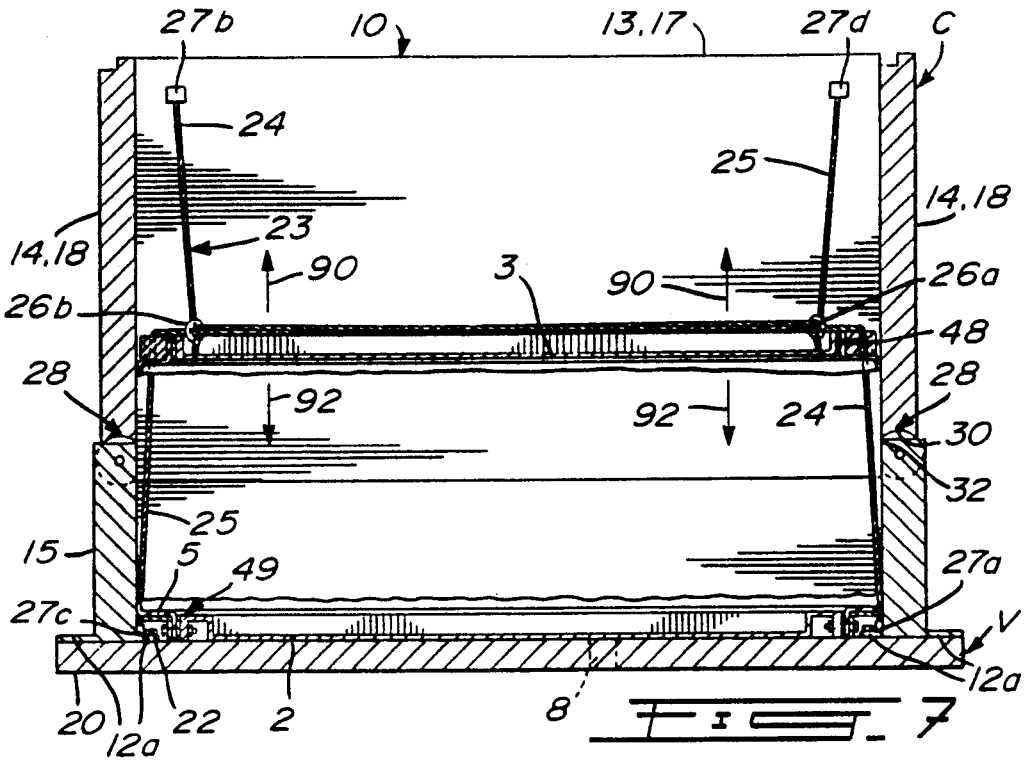
FIG. 7 is a cross-sectional fragmented side view of the cargo container in its expanded position showing the top wall in an intermediate position and further illustrating the system ensuring the horizontality and parallelism of the top wall.

FIG. 7 shows a parallel guiding system which allows the parallel vertical displacement of the platform 3 with respect to the bottom wall 2 of the expansible vessel 1. The assembly of the parallel system is identified by the numeral 23, and it is made up of a cable 24 anchored at 27*a* to the base 2, passing through a pulley or an eyebolt 26*a* on the platform 3, and crossing over to pass through another eyebolt 26*b* also mounted on the platform 3. The cable 24 is then anchored at 27*b* to the box 10. A similar cable 25 is anchored at 27*c* to the bottom wall 2 and passes through eyebolts 26*a* and 26*b*, as shown, to be anchored by anchor 27*d* on the box 10 at the top thereof. One such cable arrangement 23 is provided for each of the four peripheral sides of the platform 3 with one eyebolt being provided at each corner of the platform 3 for receiving the cables of adjacent peripheral edges of the platform, as seen in FIG. 4.

As the platform 3 travels vertically either along arrows 90 or 92, the cables 24 and 25 displace in opposite directions through the eyebolts 26*a* and 26*b* and along the top surface of the platform 3. The counter balancing effect of both cables 24 and 25 on the platform 3 ensures the parallelism thereof with respect to the base 2.

Basically, the system 23 allows the platform 3 to move vertically in a parallel system to avoid damage to the sleeve 5 (not shown in FIG. 7). The cable and pulley arrangement provides parallel movement for a tridimensional body.

Indeed, due to various frictions between the sleeve 5 and the walls 11 during platform movement, the platform 3 has a tendency to tilt thereby causing gaps between the periphery of the platform 3 and the walls 11. This results in the flexible sleeve 5 folding and being pushed by the pressure in the gaps and getting caught therein which may damage and even rupture the flexible sleeve 5.

The parallel system 23 also stabilizes the movement of the platform 3 and permits movements of the platform 3 by compressed air without requiring the stabilizing effect of liquids. This allows the positioning of the platform 3 in its upper position with the vessel 1 being empty and the locking of the platform 3 to the lid panels 17 and 18 by way of latch assemblies 34 which will be described hereinbelow. The loading of the vessel 1 with liquid thus becomes a much safer operation. It also permits the unloading of the liquid with the platform 3 in its upper position. This avoids tilting of the platform 3 while the liquid inside the vessel 1 is unloaded.

Figure 8:
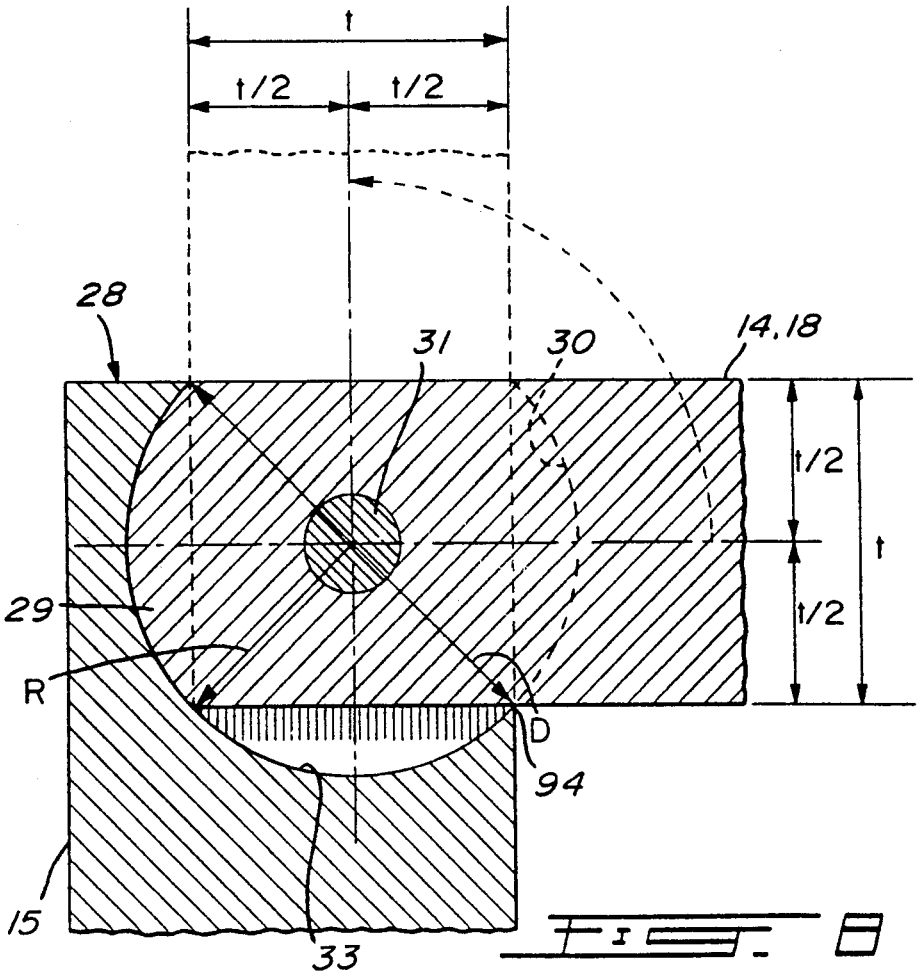
FIG. 8 is a cross-sectional view taken along lines 8—8 of FIG. 1 of a hinge assembly.

As previously mentioned, each hinge 28 provides a pivoting joint between the lid panels 17 and 18 and the pale 15. As shown in FIG. 8, the hinge 28 must operate so that the inner surfaces of the walls 11 which include the pale 15 and the lid panels 17 and 18, are smooth and flush and do not show any projections which could damage or puncture the sleeve 5 under liquid pressure and also facilitate an unimpeded displacement of the platform 3 along the walls 11. Furthermore, in closed or retracted position, the top surfaces of the pale 15 and of the lid panels 17 and 18 are flush and level, as also seen in FIG. 8. This prevents solid cargo from wedging into the hinge 28 and damaging the same when, for instance, the lid panels 17 and 18 are opened.

Figure 8A:
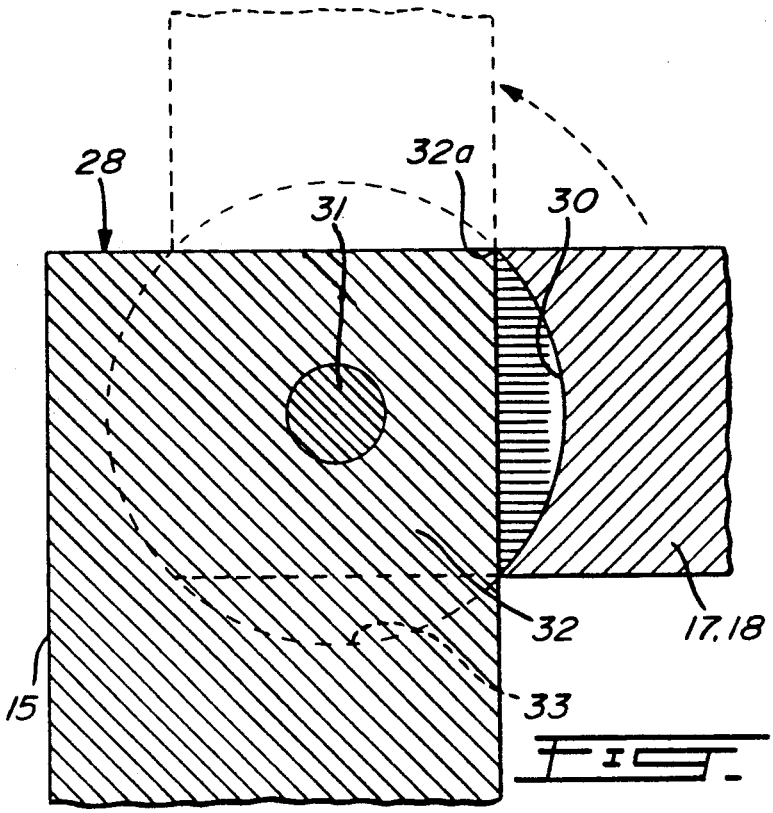
FIG. 8*a* is a cross-sectional view taken along lines 8*a*—8*a* of FIG. 1 of the hinge assembly.

Referring to FIGS. 1 and 8, the lower end of each one of the lid panels 17 and 18 includes a series of spaced apart convex end portions 29, referred hereinafter as ball portions 29, which mate with corresponding spaced apart concave seats 33 defined in the upper end of the pale 15. Each ball portion 29 is separated by a concave lid seat 30 formed at the bottom of a recess defined in the lower ends of the lid panels 17 and 18 (see FIG. 8*a*). A pale corner 32 which fits within this recess and which has perpendicular upper and inner surfaces contacts at its apex 32*a* the concave lid seat 30 (see FIGS. 1 and 8*a*). A shaft 31 extends through the ball portions 29 of the lid panels and through the upper pale corners 32 of the pale 15 in a position to ensure a concentricity of the movable mating portions forming the hinge 28. Therefore, upon a pivot of, for instance, the side lid panel 18, the ball portions 29 rotate along the concave pale seats 33 while the concave lid seats 30 rotate with the pale corners 32 sliding thereon.

The provision of a plurality of ball portions 29 separated by the pale corners 32 distributes the load applied to the lid panels 17 and equally along the pale 15 by way of the pale corners 32.

One manner of constructing the hinge 28 is for the ball portions 29 and the lid and pale seats and 33 to have a radius of curvature R equal to half the diagonal of a square inscribed in a circle of radius R and having sides equal to the thickness of the lid panels 17 and 18, as seen in FIG. 8.

Accordingly, the following formulas can be obtained:

$$D=2R \text{ and } D^2=t^2+t^2;$$

therefore, $$D = t\sqrt{2} \text{ and } R = \frac{t}{2}\sqrt{2}$$

where t is the thickness of the lid panels 17 and 18, and

D is twice the radius of curvature R of the ball portions 29 and of the lid and pale seats 30 and 33, respectively, and also corresponds to the diagonal of a square having t as sides.

In the open position, the inside surfaces of the lid panels 17 and 18 are level, smooth, and flush with the inside surfaces of the pale 15. In the closed position, the lid panels 17 and 18 are in contact with and supported by inside tips 94 of the pale seats 33. The lid panels 17 and 18 rotate freely 90 degrees around the center of the shaft 31 between the open vertical and closed horizontal positions.

The close contact between the ball portions 29 and the concave pale seats 33 minimizes penetration of materials into the platform area and thus seals the platform 3 from the outside and consequently reduces the possibility of damage to the flexible sleeve 5 or to the hinges 28.

The latch assemblies 34 are provided about the periphery of the platform 3 to lock the platform, when expanded, to the walls 11. For instance, these latch assemblies 34 which are provided at intervals around the periphery of the platform 3 (see FIG. 4) each include cooperating inner and outer latches 35 and 36 mounted respectively on the platform 3 and on the walls 11, as will now be described with reference to FIGS. 9 to 11.

The outer latch 36 is a L-shaped bracket 37 having its horizontal portion secured to the wall 11 and its vertical portion extending downwards at a distance from the wall 11. An elongated slot 38 is defined horizontally through the vertical portion of the bracket 37.

The inner latch 35 includes a L-shaped angle 39 having its vertical portion mounted at a lower end thereof to the platform 3 and having its horizontal portion extending from the upper end of the vertical portion towards the outside, that is towards the wall 11. A slot 40 is defined in the horizontal portion of the angle 39 parallel to the wall 11. The angle slot 40 is adapted to engage the vertical portion of the bracket 37 when the platform 3 is raised. The lower edges of the vertical portion of the bracket 37 are chamfered to facilitate the penetration thereof in the slot 40 of the angle 39. The top edges defining the angle slot 40 are countersunk also to facilitate the penetration of the bracket 37 in the angle 39.

A cam 41 which is mounted by way of a cam shaft 42 on the underside of the horizontal portion of the angle 39 is adapted to rotate in a horizontal plane. The cam 41 includes a head 41*a* which is adapted to engage the bracket slot 38 upon a pivot of the cam 41. The bracket slot 38 tapers towards the wall 11 in order to facilitate the penetration of the cam head 41*a* therein.

The chamfers and tapers besides assisting the penetration also correct any misalignment of the bracket 39 with the angle slot 40 and of the cam head 41*a* with the bracket slot 38.

Figure 9:
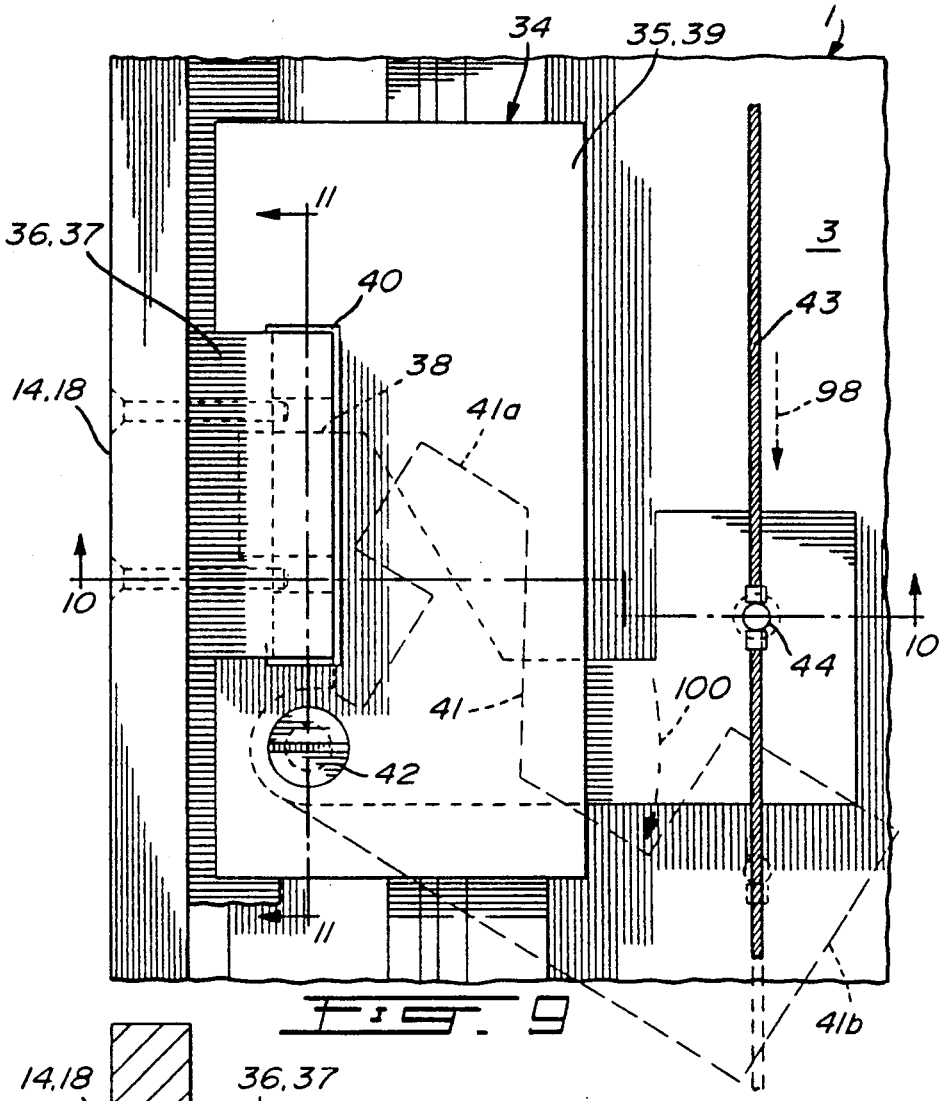
FIG. 9 is a top plan view of a latch assembly.

As seen in FIGS. 4 and 9, a single cable or rope 43 connects all of the cams 41. By pulling the rope 43 in one direction, all of the cams 41 are engaged in the corresponding bracket slots 38 of the wall brackets 37, while pulling the rope 43 in the opposite, direction disengages the cams 41 from the wall brackets 34. The rope 43 is connected to each cam 41 by means of a pivot 44. The pivot 44 rotates in the cam body 41*b*.

The pulleys 45, as shown in FIG. 4, are provided on the platform 3 to guide the rope 43 in its reciprocating movement. A pulling and locking mechanism 46, as shown in FIG. 4, may be provided for pulling the rope in either direction as required for locking the rope 43 in either the latch locked or unlocked positions.

When it is required to move the platform 3 upwardly to its uppermost position, the wall brackets 37 engage the angle slots 40 until the platform 3 movement is stopped when the horizontal portions of the inner angles 39 contact the underside of the horizontal portions of the wall brackets 37. The wall brackets 37 fit tightly into the inner angles 9. Compressed air is applied to the platform 3, thus forcing it upward, and consequently, the wall brackets 37 are forced into the corresponding angle slots 40 for proper alignment. In this situation, the platform 3 is prevented from further upward and horizontal movement.

After the platform 3 reaches its uppermost position, the cams 41 are actuated by means of the pulling and locking mechanism 46 (rotated along arrow 96 in FIG. 4) acting on the rope 43, and the cam heads 41*a* engage in the bracket slots 38. The rope 43 is then locked in place, and vessel pressure is released which allows the platform 3 to slightly lower until the cam heads 41*a* are supported by the wall brackets 37. The platform 3 is thus prevented from any downward movement. To unlock the platform 3, the platform is pushed upwardly by air pressure once the vessel 1 is empty of liquid to free it from its weight right up to its uppermost limit where the platform, 3 contacts the wall brackets 37, and then the cams 41 are actuated by means of the rope 43 along arrow 98 retracting the cams which rotate as indicated by arrow 100 and allowing the platform 3 to move downwardly. The platform 3 will lower under its own weight with the rate of descent being controlled by controlling the flow of air out of the vessel 1 through the vent 7.

The latch assemblies 34, therefore, provide the following functions, that is:

- to prevent further upward movement of the platform 3,
- to prevent downward movement of the platform 3, and
- to tie all the walls 11 to the platform 3 to increase the strength of the walls.

Thus, the platform 3 is firmly locked with the walls creating a strong fixed rigid box having a top, base, and walls. This prevents any movement of the platform 3 either in vertical or horizontal directions. The walls 11 are strengthened by means of this connection with the platform 3 which prevents their bulging under the pressure of the liquid in the vessel 1 and allows for lighter and stronger design, thereby reducing the cost and weight of the walls 11. As many as 20 or more latch assemblies 34 may be mounted on a 20×8 foot expansible container C.

The latch assemblies may be adapted in order to vary their vertical position in the box 10, thereby changing the position of the platform 3 and consequently varying the volume of the vessel 1 and reducing the sloshing.

This can be achieved by having a series of removable bolts securing the outer latches 36 to the lid panels 17 and 18 and by adapting these lid panels to receive the bolts at various elevations. As a result, , the container C becomes a variable volume container. This eliminates the need of baffles to reduce sloshing and liquid movement when the container is not filled up to the top.

Such a vertical adjustability of the platform 3 is necessary, for example, in the case where a container is designed to carry a specified limit weight of water and where a liquid of higher specific gravity than water is intended to be loaded in and transported by the container. Indeed, the allowed volume for such a liquid is lower than that of water, and thus require a lower positioning of the platform 3 to reduce the vessel volume.

Referring now to FIGS. 12 to 15, there is shown the flanges 47 which are provided for effecting a hermetic seal between the flexible side walls of the sleeve 5 and the platform 3 and the base 2. There is a first peripheral flange 48 at the top of the flexible sleeve 5 and a peripheral bottom flange 49 sealing the sleeve 5 respectively to the platform 3 and to the bottom wall 2. The seal is accomplished without, for example, having to fold the peripheral top portion of the sleeve 5 over the upper peripheral surface of the platform 3. Customarily, a seal of two pieces is executed in one plane and the two joining surfaces lie in the same plane. If a one-plane arrangement was applied to the present container C, a special pocket-type three-wall corner would have to be made. This would preclude the use of a readily available, standard sheet precured material to manufacture the flexible sleeve 5. An uncured material would be required to form the corner which would necessitate complicated and expensive molding and curing facilities and operations.

The present sealing method allows for the sealing on four separate sides situated in four different vertical planes including four vertical corners. This is made possible by spliting the outer flange into sections without compromizing the continuity of the seal and sealing pressure between the inner and outer flanges. The length of the outer flange is adjustable.

An inner flange 50 in the form of a continuous bar extends around the edges of the platform 3. The bar is welded to the platform 3 and projects upwardly therefrom. Similarly, a continuous bar or flange 50*a* extends around the edges of the base 2, with the bar being welded to the base and projecting upwardly from the base. At intervals in the inner flanges 50 and 50*a*, there is a series of horizontal holes having diameters sufficient to receive a series of bolts 58 and 58*a*. Hereafter, only the top flange 48 will be described as the bottom flange 49 is similar thereto. Corresponding reference numerals for the bottom flange 49 are characterized by the suffix "a" attached thereto.

An outer flange 51 is split into straight sections 52 and corner sections 53. The outer flange 51 is located between the inner flange 50 and the walls 11 The outer flanges 51 and 51*a* extend respectively around the platform 3 and the base 2. The length of the outer flange 51 is adjustable to permit application of sufficient and continuous sealing pressure at the total periphery of the flexible sleeve 5. At intervals corresponding to that of the inner flange 50, there is a series of horizontal apertures having a diameter sufficient to receive the series of bolts 58.

Figure 13:
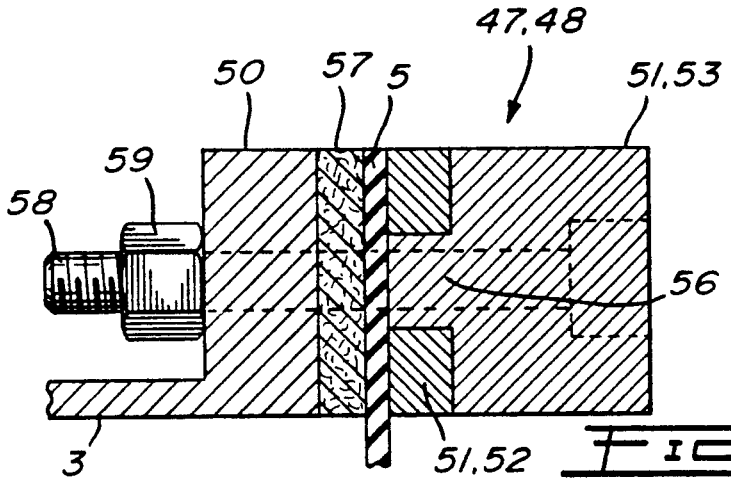
FIG. 13 is a cross-sectional view taken along lines 13—13 of FIG. 12.
Figure 14:
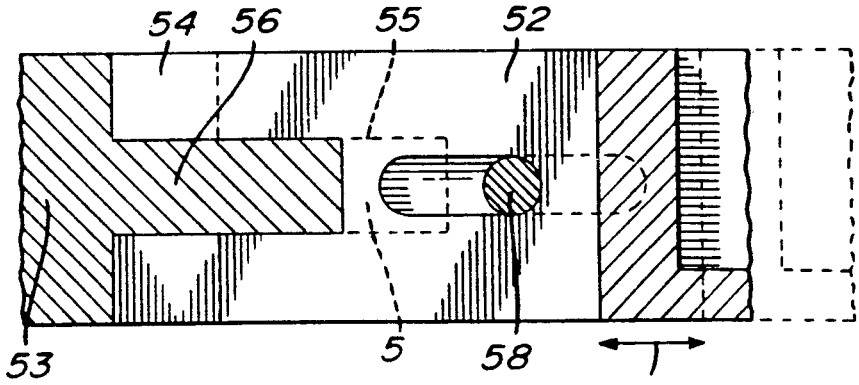
FIG. 14 is a cross-sectional view taken along lines 14—14 of FIG. 12.

There may be four or more of the straight sections 52 for the outer flange 51. The corner sections 53 are provided at each corner. Joints 54 are each formed by a female notch 55 defined in one outer flange section and a cooperating male shoulder 56 protruding from a successive outer flange section in order to prevent discontinuity of the straight and corner sections 52 and 53. The joints 54 allow for changing the relative positions of two successive sections, thus making possible adjustment of the length of the outer flange 51. For adjustment purposes, the two joining sections may be slid towards each other or away from each other as indicated respectively by arrows 102 and 104 in FIGS. 12 and 14. In FIGS. 13 and 14, two sections 52 and 53 are so engaged, yet are free to slide freely. The shoulder 56 of one section penetrates into the notch 55 of an adjacent section. A continuous gasket 57 extends between the inner flange 50 and the sleeve 5. The gasket 57 eliminates leakage of the contents of the vessel 1. Bolts 58, of course, pass through the inner flange 50, the gasket 57, the vessel 1 and the outer flange 51 once the sections of the outer flange 1 have been properly adjusted. Self locking nuts 59 and bolts 58 provide the necessary pressure to the sealing surfaces.

Figure 10:
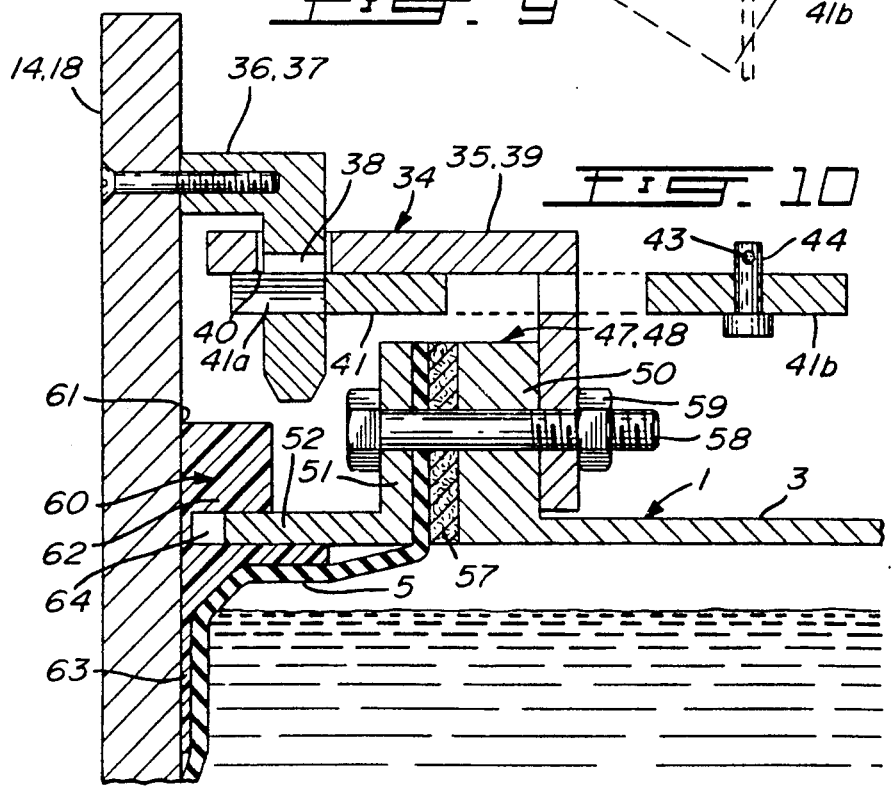
FIG. 10 is a cross-sectional view taken along lines 10—10 of FIG. 9.
Figure 15:
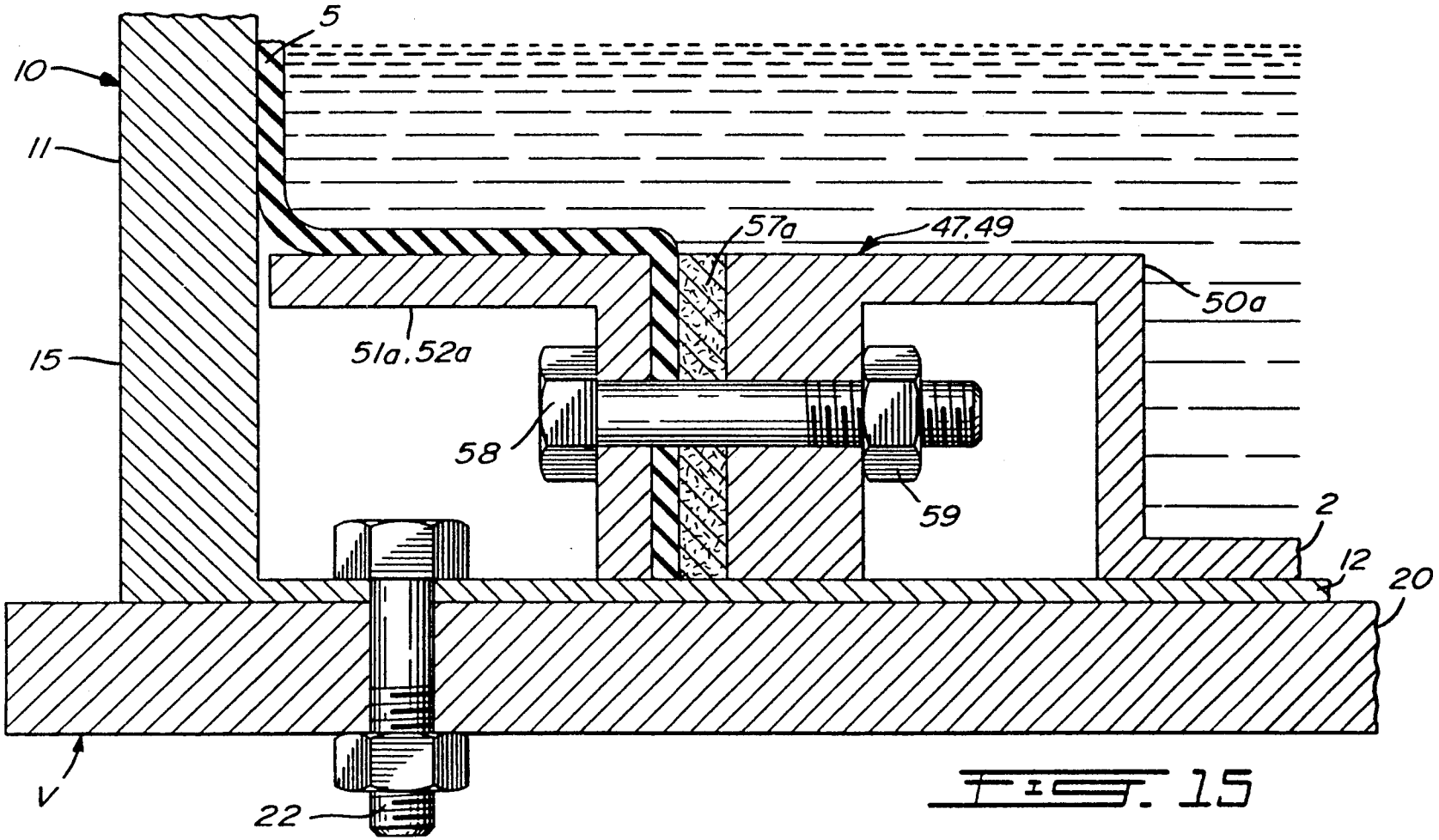
FIG. 15 is a cross-sectional view of the bottom peripheral flange.

Now referring to FIG. 10, arresting brackets 60 prevent pinching which might occur in the infiltration gaps 61 defined between the platform 3 and outer flange 51 and the walls 11. The arresting brackets 60 are split into shorter sections for added flexibility and gap adjustment and are placed along the straight sections 52 of the outer flange 51. The arresting brackets 60 each include a horizontal bar 62 oriented towards the outer flange 51. The bar 62 defines a longitudinal groove 64 to fit on and to slidably receive the bottom horizontal leg of the top outer flange 51, as shown in FIG. 10. The groove 64 allows the arresting bracket 60 to be held by and slide away from and towards the outer top flange 51. The arresting bracket 60 also includes a vertical plate 63 extending downwards from the horizontal bar 62 which is adapted to slide on the inner surface of the walls 11. This plate 63 has the role of a flapper which is pushed by the sleeve 5 against the walls 11 and enables the closing of the infiltration gap 61.

The arresting bracket 60 basically prevents the wall of the flexible sleeve 5 from being pushed and caught in the gap 61 between the outer flange 51 and the box walls 11. This normally occurs when the gap 61 is large enough for the sleeve 5 to be squeezed and pushed into the gap 61. This is facilitated by wall friction between the box walls 11 and the sleeve material as well as by the internal pressure of the vessel 1. When the sleeve material penetrates into the gap 61, the sleeve 5 may become damaged and punctured.

The penetration gap 61 increases with any slight tilt of the platform 3. If the penetration gap 61 is too small, the platform 3 may jam inside the walls 11.

The top horizontal grooved bar 62 receives in its groove 64 the bottom horizontal leg of the top outer flange 51 so that the bracket 60 may slide freely toward and away from the outer flange 51 and consequently may slide toward and away from the box walls 11. When the sleeve 5 is pushed toward the box walls 11 and toward the platform 3 and the gap 61, the sleeve 5 pushes the vertical plate 63 and thus the arresting bracket 60 against the walls 11, thereby closing the gap 61, and preventing the sleeve 5 from penetrating into the gap 61. The arresting bracket 60 makes possible the use of flat sheet material to fabricate the sleeve 5.

The arresting bracket 60 eliminates the need for:

- the sleeve to be formed or pleated with a series of corrugations so that the sleeve can extend in concertina-like fashion,
- reinforcing the outwardly directed corrugations with strips,
- the provision of tie belts secured to the strips and to the platform.

Figures 16, 17:
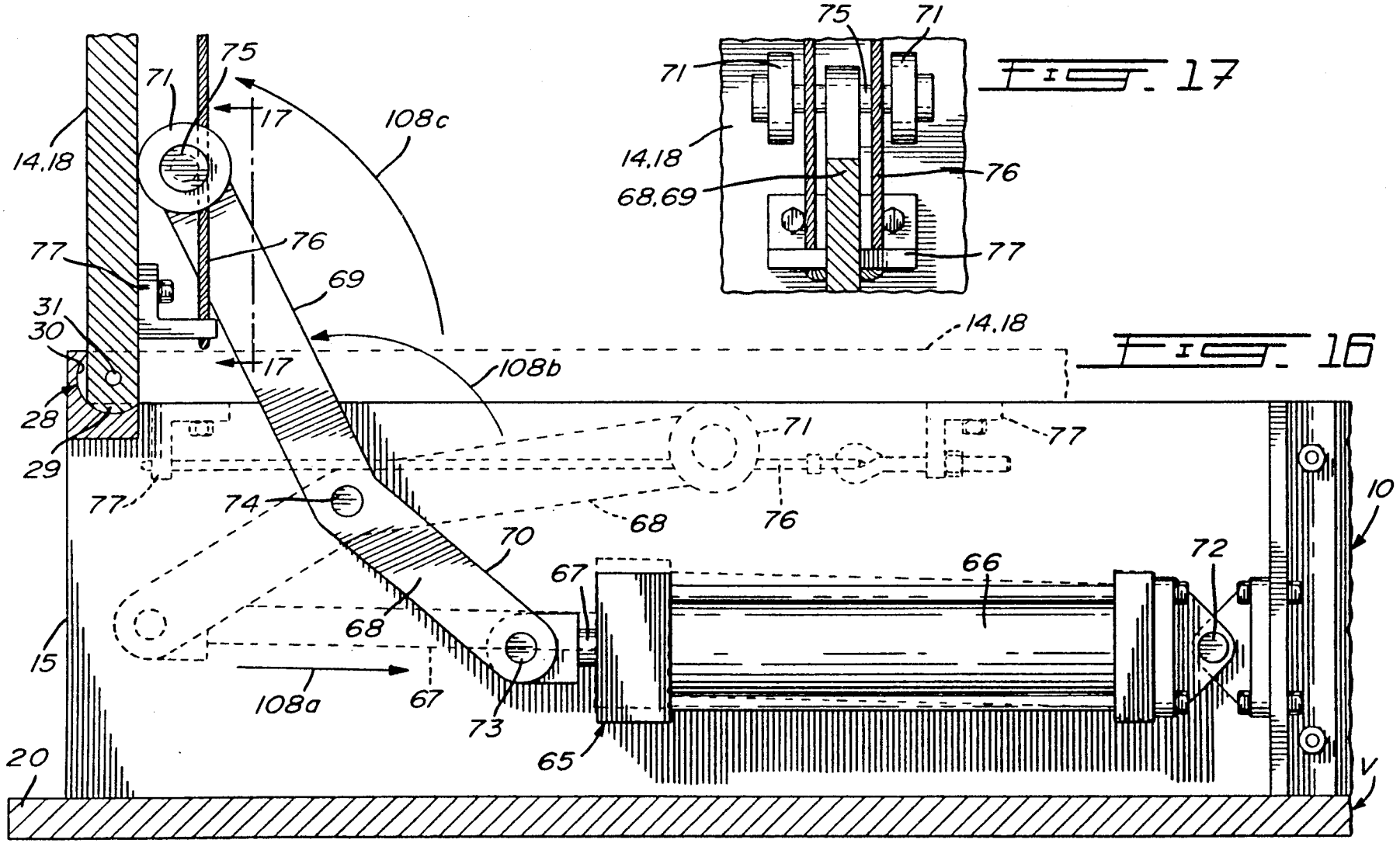
FIG. 16 is a side elevation of a panel actuator showing the panel in its opened position and, in broken lines, in its closed position.
FIG. 17 is a cross-sectional view taken along lines 17—17 of FIG. 16.

A typical side lid actuator 65 which is shown in FIGS. 16 and 17 operates the side lid panels 18, for instance, and there would be four actuators 65 for each two lid panels. The actuators 65 open the lid panels 18 as well as close the lid panels. Normally, the lid panels 18 are too heavy to be closed or opened manually. There is a considerable limitation of headroom space between the lid panels 18 and the vehicle floor 20 because of interference with the vehicle structure. If one end of the arm was fixed to the cylinder shaft and the other to the lid panel 18, it would require considerable headroom.

In order to overcome this headroom problem, each actuator 65 includes a cylinder 66 which is pivotally mounted to the container C by a pin 72, a cylinder shaft 67 reciprocating out of the cylinder 66 and a crook lever arm 68 having upper and lower arms 69 and 70 which is connected at one end by a pivot 73 to the end of the cylinder shaft 67 and which is provided at the other end with one or two rollers 71 that can move freely and in continuous running contact with the surface of the lid panels 18. The lid panels 18 require the greatest force at the beginning of the pivoting movement from the closed position. This requirement is matched by the longest force lever at the beginning of upward movement, the force lever being the variable distance between the lid hinge 28 and roller contact point with the lid panel 18. As the lid panel 18 moves upwards the force lever becomes shorter.

As the cylinder shaft 67 gets shorter (see arrow **108*a*) and the arm 68 rotates about an arm shaft 74 (see arrow 108*b*), the rollers 71 apply pressure on the lid panel 18 and move it upwards until the lid panel 18 is fully opened (see arrow 108*c*). When the cylinder shaft 67 expands, the roller shaft 75 slides on and pulls the cables 76 which extend parallel to and spaced from the underside of the lid panel 18 between a pair of brackets 77 and which bear against the roller shaft 75 for closing the lid panel 18**.

Thus, the lid actuator 65 includes the cylinder 66 which can be pneumatic or hydraulic power operated and the cylinder shaft 67 which is pivotally connected to the crook arm 68 which is in turn pivotally mounted to the arm shaft 74, dividing the crook arm 68 into the upper and lower arms 69 and 70. The lower arm 70 is connected to the cylinder shaft 67 by the pivot 73. The rollers 71 are provided at the other end of the upper arm 69. The cylinders 66 are themselves pivotally mounted about the fixing pins 72 which are secured to a C-shaped bracket 106 fixed to the structure.

The pivot shaft 74 may also be fixed to the structure at both ends. The rollers 71 are mounted on the roller shaft 75 with the cable 76 extending between the brackets 77 and retaining the rollers 71 against the lid panel surface.

Figure 6:
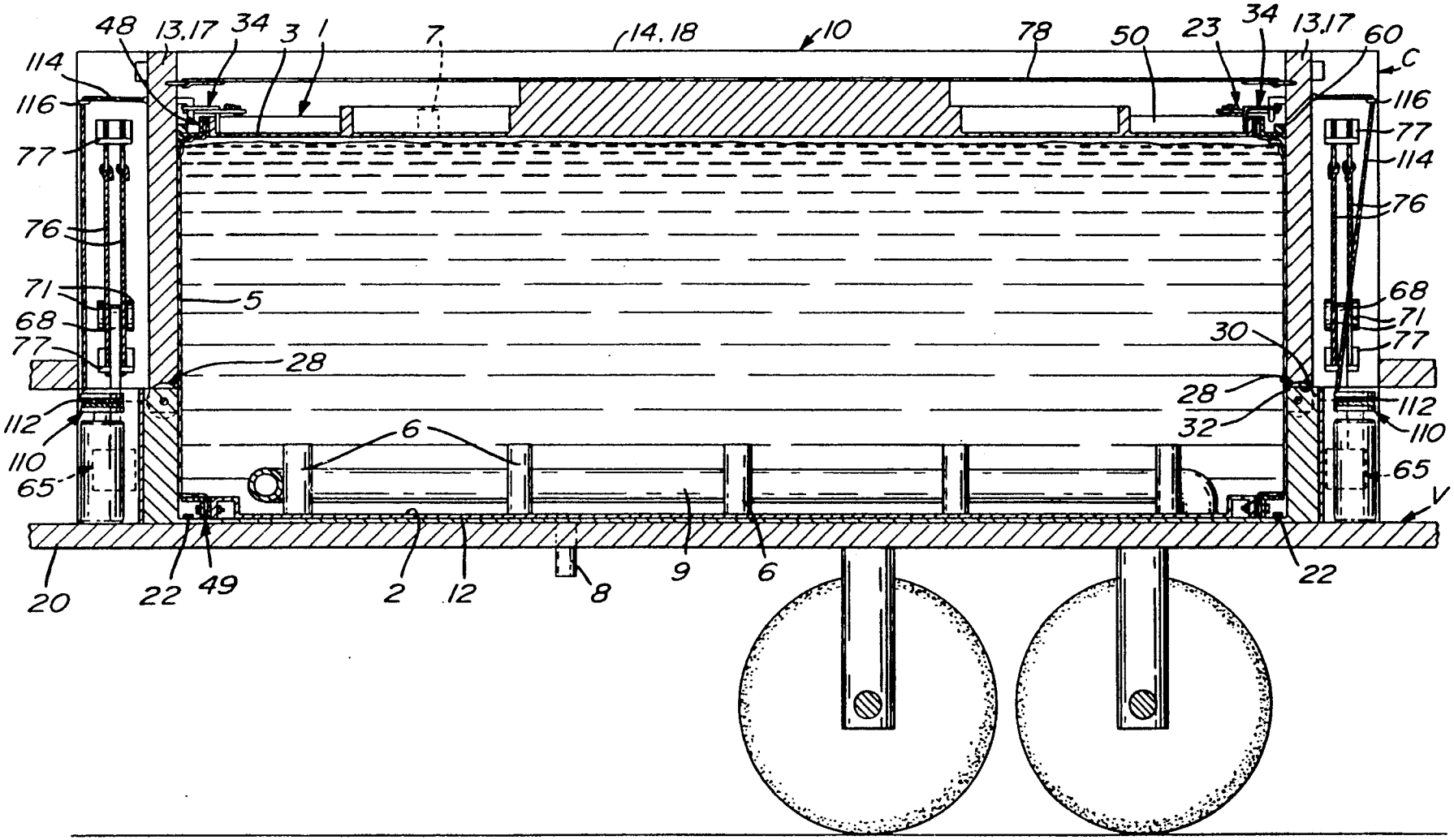
FIG. 6 is a cross-sectional elevation taken along lines 6—6 of FIG. 4.

Now referring to FIGS. 4 and 6, an end lid actuator mechanism 110 is provided to raise each of the end lid panels 17 once the side lid panels 18 have been opened by the lid actuators 65. The end lid actuator mechanisms 110 each include a winch 112 mounted in a horizontal plane between the C-shaped bracket 106. A pair of cables 114 are wound around each of the winches 112 and are guided by eye-bolts 116 before being connected on the outside to the upper corners of the end lid panels 17. A counterclockwise rotation of the winches 112 will cause the cables 114 to wind therearound, thereby pulling at an angle from above on the end lid panels 17 and raising the same from their retracted position to their expanded position. A clockwise rotation of the winches 112 will allow the end lid panels 17 to lower under gravity forces.

It is noted that the side walls 14 and thus the side lid panels 18 extend horizontally, when the box 10 is expanded, further than the end walls 13 and the end lid panels 17 in order that, when the box 10 is completely retracted, the side lid panels 18 cover the side and end lid actuators 65 and 110 to prevent solid cargo from damaging the same. Furthermore, such a construction results in that the end lid panels 17 when raised, extend between the side lid panels 18, thereby providing support therefor without further assistance from the side lid actuators 65, whereas the end lid panels 17 will get their outwards support from the tight cables 114 of the end lid actuators 110.

As seen in FIG. 4, tie straps 78 may be provided and are used to tie up opposite pairs of the walls 11 to prevent bulging of the walls by inner pressure while the platform 3 is moving vertically and before the latch assemblies 34 are engaged. The tie straps 78 limit as they become tight the expansion or opening of the end and side lid panels 17 and 18 to their vertical positions when the end and side lid actuators 110 and 65 are respectively operated. The tie straps or tie cables 78 are installed permanently and are stored underneath the lid panels 17 and 18 when retracted.

The box 10 may be formed of plain fixed walls which are all made from one part panels. On the other hand, the box 10 may comprise pivoting walls which are all lidded, as illustrated. Also, the box 10 can be made of one lidded wall with the three remaining walls being plain fixed walls, or of any other combination of plain and lidded walls.

Advantages of lidded walls with respect to plain unhinged walls will now be presented.

In general, receiving vehicles and cargo containers do not have sufficient strength to resist liquid pressure of the flexible container. Also, the inner surface of the receiving vehicles and cargo containers is not smooth and continuous enough to avoid damage to the flexible sleeve.

The lid system makes the expansible container autonomous and independent of the wall structure of the receiving vehicles and cargo containers. Also, the expansible container may be mounted on a flat bed not having any side walls.

Since the lid panels serve as walls in the vertical position and as a false floor in the horizontal position, the need for separate structural panels is eliminated. The lids' double function reduces the structural members which would be otherwise required for the walls and the false floor. This reduces weight and cost of the expansible containers.

The lid panels forming the false floor are firmly supported at their periphery on the hinge mechanism. This eliminates a cantilever hanging of the platform when the walls are unhinged and cannot close. The false floor supported centrally on the pillars and secured on its periphery to the pale through a hinge arrangement is much stronger and rigid than a floor supported on pillars only.

When the lid panels close, there is a full and unobstructed width of the receiving container. Space is at a premium when transporting solid cargo. In the case of four hinged walls, the horizontal dimensions of the receiving vehicles or cargo containers remain unchanged before and after installation of the expansible container.

The lid system eliminates any contamination of the solid cargo in the case when the inside surface of the box walls gets dirty. Without the lid panels, the solid cargo is in contact with the inner surface of the walls. When the lid panels are closed, the lid system ensures that the solid cargo is only in contact with the outside surface of the lid panels and with the walls of a receiving vehicle container.

The lid system allows installation of latches projecting from the lid panels on the inside of the box. Also, a strap system may be installed to tie together the opposite lid panels. This prevents bulging of the walls by internal pressure during the vertical movements of the platform and, in the case of the ascent of the platform, before it is locked in place by the latch system. When the lid panels are closed, all protruding items are hidden away and do not interfere with the solid cargo. Without the lid system, no protruding objects could be tolerated inside the walls, and consequently, no latches or other locking devices or straps could be permanently installed on the inside of the walls.

The false floor, made of two overlapping lid panels, prevents any foreign material from falling and getting caught between the walls and sleeve, thus preventing damage to the sleeve.

The platform may be open at its top, allowing easy access to various mechanisms like the latches, the arresting brackets, the parallel system, the straps and also allowing visual observation as to whether the sleeve is caught between the wall and peripheral flange. By closing the lid panels, all items and mechanisms are protected and hidden, and there is, no interference with the solid cargo. The false floor is smooth and clean.

I claim:

1. A cargo container adapted to transport liquids and, alternatively, solid cargo, comprising a box-like housing having rigid side walls and an expansible vessel mounted inside the box-like housing adapted for receiving and containing the liquids and including a rigid bottom wall, a rigid top wall extending parallel to the bottom wall, and flexible impermeable side walls extending between the vessel top and bottom walls, the vessel top wall being adapted for movement within the box-like housing between a retracted position where the top wall is adjacent to the bottom wall with the vessel side walls collapsed therebetween and an expanded position, said rigid side walls including at least one panel adapted to be folded down onto the vessel top wall when the expansible vessel is retracted in order to serve as a floor for the solid cargo, means being provided for maintaining said vessel top wall substantially parallel to said vessel bottom wall when the vessel top wall is vertically displaced, means being provided for preventing said vessel side walls from penetrating into gaps defined between said vessel top wall and said rigid side walls, said vessel being adapted to receive air therein for raising said vessel top wall to said expanded position, means being provided for securing said vessel top wall in said expanded position to the box-like housing.

2. A cargo container as defined in claim 1, wherein a sleeve forms the vessel side walls, said sleeve being made from a straight, flat, uncorrugated, flexible and impermeable material sealingly secured at opposite ends thereof to said vessel top and bottom walls.

3. A cargo container as defined in claim 2, wherein each of said rigid side walls comprises one said panel, a separate hinge means being provided for mounting each of the panels to said box-like housing between horizontal folded and vertical unfolded positions, vessel top wall support means being provided for supporting in said retracted position said vessel top wall parallel to said vessel bottom wall and spaced apart therefrom for preventing damage to the retracted sleeve, said panels being adapted in said folded position thereof to overlap one another and the vessel top wall for forming a continuous plane horizontal false floor for the solid cargo which is supported by said hinge means and said vessel top wall support means.

4. A cargo container as defined in claim 3, wherein said vessel top wall support means comprises a series of spacer means extending at right angles in said vessel from said vessel bottom wall for providing distributed support to said vessel top wall in said retracted position.

5. A cargo container as defined in claim 4, wherein each said spacer means comprises a pillar.

6. A cargo container as defined in claim 3, wherein said hinge means are adapted to provide in said unfolded position a substantially continuous plane inner vertical surface to each of said rigid side walls in order to allow for minimal size gaps between said vessel top wall and said rigid side walls while allowing the vertical displacement of said vessel top wall, said hinge means being further adapted to provide in said folded position a substantially continuous plane upper surface to each of said rigid side walls for receiving the solid cargo.

7. A cargo container as defined in claim 6, wherein said hinge means is formed by a peripheral end of said panel cooperating with an upper portion of a fixed lower section of a respective one of said rigid side walls of said box-like housing, said panel peripheral end comprising at least one convex arcuate portion extending between top and bottom walls of said panel and having a curvature radius R about a pivot axis, said pivot axis being coplanar with a longitudinal symmetry plane of said panel with said curvature radius R being established by the formula:

$$R = \frac{t}{2}\sqrt{2},$$

wherein t equals a thickness of said panel;

said convex arcuate panel portion being rotatable within a longitudinal concave recess of semi-circular cross-section having a radius equal to said curvature radius R and defined about said pivot axis at a 45° angle in a top inner corner of said upper portion between ends of said upper portion of said fixed lower section of said respective rigid side wall, said panel being rotatable on a shaft coaxial with said pivot axis and extending through said panel peripheral end and having the ends thereof mounted in said ends of said upper portion.

8. A cargo container as defined in claim 7, wherein said panel peripheral end comprises a series of longitudinally aligned and spaced apart convex arcuate portions with a series of corresponding spaced apart concave recesses being defined in said top inner corner of said upper portion of said fixed lower section of said rigid side wall, whereby said upper portion defines a series of top inner corner sections longitudinally spaced by said concave recesses, concave seat portions of curvature radius R being defined in said panel peripheral end between said convex arcuate portions and opposite said top inner corner sections, said concave seat portions being adapted to rotate on said top inner corner sections upon a pivot of said panel.

9. A cargo container as defined in claim 3, wherein peripheral top and bottom flange assemblies are provided for sealingly securing said sleeve vertically around vertical peripheral sides respectively of said vessel top and bottom walls.

10. A cargo container as defined in claim 9, wherein both said top and bottom flange assemblies comprise a peripheral inner flange secured around said peripheral sides and a peripheral outer flange mounted to said vessel with said sleeve end vertically surrounding said inner flange and being secured between said inner and outer flanges.

11. A cargo container as defined in claim 10, wherein a seal gasket is provided between said sleeve end and said inner flange.

12. A cargo container as defined in claim 11, wherein said outer flange comprises corner sections and at least one straight section extending between each pair of successive corner sections.

13. A cargo container as defined in claim 12, wherein said corner and straight sections include portions horizontally overlapping each other, each arrangement of said overlapping portions including a recess means defined longitudinally at the end of one of said portions and adapted to slidably receive a finger means protruding from the other one of said portions, whereby a proper longitudinal insertion of said finger means in said recess means provides for a longitudinal adjustability of said corner and straight sections one with respect to the other while maintaining a continuous peripheral contact between said outer flange and said sleeve end and thus a continuous peripheral seal.

14. A cargo container as defined in claim 3, wherein said means for preventing said vessel side walls from penetrating into the gaps formed between said vessel side walls and said rigid side walls comprises at least one gap closing bracket provided at each peripheral side of said vessel top wall for preventing said sleeve from wedging into said gaps, said bracket comprising a vertical plane outer surface and an inner surface which defines a horizontally extending groove, said vessel top wall comprising at each peripheral side thereof at least one horizontal member extending outwards towards said rigid side walls and being spaced therefrom and slidably engaging said groove, said sleeve extending downwards from said vessel top wall and under said bracket and bearing against a portion of said bracket lower than said groove for maintaining said outer surface of said bracket against said rigid side walls and thus close said gap, said bracket being slidable on said horizontal member in order to cover various gap sizes while still being retained in position between said vessel top wall and said rigid side walls.

15. A cargo container as defined in claim 3, wherein said means for securing said vessel top wall in said expanded position comprises a series of latch assemblies provided for securing said vessel top wall to said panels in said expanded position of said vessel, whereby said vessel can be expanded by air pressure from said retracted position to said expanded position at which point said vessel top wall is secured to said panels by said latch assemblies thereby allowing removal of air pressure in the expanded vessel for receiving the liquids.

16. A cargo container as defined in claim 15, wherein said latch assemblies comprise cooperating inner and outer latches provided respectively along the upper periphery of said vessel top wall and the inner periphery of said panels, each pair of cooperating inner and outer latches being adapted to engage one another at said expanded position of said vessel and to be secured together for mounting the expanded vessel top wall to the unfolded panels.

17. A cargo container as defined in claim 16, wherein a plurality of said series of said latch assemblies are provided at various horizontal planes, whereby said vessel top wall can be secured to the unfolded panels at various horizontal positions intermediate said expanded and said retracted positions thereof, thereby providing a variable volume vessel for the cargo container.

18. A cargo container as defined in claim 16, wherein said outer latches each comprise an inverted L-shaped bracket having a vertical portion projecting downwards at a distance from a respective one of said panels and a bracket slot defined in said vertical portion, said inner latches each comprising an inverted L-shaped angle projecting upwards from said vessel top wall and having a horizontal portion spaced apart therefrom and extending outwards towards the respective panel, an angle slot being defined in said horizontal portion with said vertical portion of said wall bracket being slidable in said angle slot, said inner latch also including a cam means pivotally mounted under said horizontal portion of said angle and adapted upon a pivot thereof to engage said bracket slot, whereby, when said vessel top wall is being expanded, said wall bracket engages said angle slot with the upwards movement of said vessel top wall being limited by said angle abutting an underside of said wall bracket horizontal portion thereby allowing said cam means to be pivoted for engagement in said bracket slot and for limiting a downwards movement of said vessel top wall when the vessel air pressure is removed from said vessel.

19. A cargo container as defined in claim 17, wherein a cable means is fixed in succession to the cam means of each of said series of latch assemblies, the ends of said cable means being attached to a pulling and locking mechanism provided on said vessel top wall for forming a closed loop, whereby said cable means can be pulled selectively in either one of two directions for one of engaging and disengaging said cam means of said inner latches from said outer latches.

20. A cargo container as defined in claim 3, wherein said means for maintaining said vessel top wall parallel to said vessel bottom wall when the vessel is vertically displaced comprises a parallelism means for each peripheral sides of said vessel top wall, said parallelism means including first and second tight cable means and a pair of cable guiding means provided at successive corners of said vessel top wall, said first and second cable means being attached at first ends thereof to different upper corners of a respective one of said panels corresponding to said successive corners, said first ends of said cable means being attached at a same horizontal level and symmetrically on each side of a vertical symmetry plane of said vessel top wall, said symmetry plane being perpendicular to the respective panel, said cable guiding means being also horizontally level and disposed symmetrically on each side of said symmetry plane, said cable means extending downwards with each cable means first engaging a different one of said guiding means, then extending parallel to said vessel top wall and engaging the other guiding means, said cable means being secured at second ends to said container lower than said vessel top wall in said retracted position, said second ends of said cable means being also attached at a same horizontal level and symmetrically on each side of said symmetry plane, whereby, upon vertical movement of said vessel top wall, said cable means displace in opposite parallel directions between said cable guiding means, said tight cable means exerting counterbalancing forces on said vessel top wall thereby maintaining the parallelism thereof.

21. A cargo container as defined in claim 20, wherein each said guiding means comprises an eye-bolt mounted on an upper corner surface of said vessel top wall.

22. A cargo container as defined in claim 3, wherein panel pivoting means are provided for pivoting said panels from at least said folded position to said unfolded position thereof.

23. A cargo container as defined in claim 22, wherein said panel pivoting means comprises at least one actuator means for pivoting each of at least two of said panels between said folded and said unfolded positions thereof, said actuator means including a cylinder pivotally mounted in a substantially horizontal position to said container lower than said hinge means, a cylinder shaft reciprocating in said cylinder and pivotally mounted to a first end of a lever arm, roller means being rotatably mounted at a second end of said lever arm and being adapted for rolling against the panel while maintaining contact therewith, said lever arm being rotatably mounted in a vertical plane to said container intermediate said first and second ends thereof and higher than said cylinder for pivoting about a horizontal axis, and being adapted to raise and lower the panel when said cylinder shaft is respectively retracted and expanded with respect to said cylinder.

24. A cargo container as defined in claim 22, wherein said panel pivoting means comprises at least one actuator means for pivoting each of at least two of said panels from said folded to said unfolded positions thereof, said actuator means including a winch means rotatably mounted to said container, a pair of cable means attached at first ends thereof to said winch means and at second ends thereof each to a different one of the two inward corners of the panel when folded, cable guiding means being provided between said winch means and the panel at a location at least as high as said second ends of said cable means when the panel is unfolded, whereby said winch means is adapted to wind said cable means therearound and to thus pull on the panel in order that the panel pivots upwards towards said unfolded position.

25. A cargo container as defined in claim 22, wherein panel unfolding limiting means are provided for preventing said panels to pivot during raising thereof past said unfolded vertical position thereof.

26. A cargo container as defined in claim 25, wherein said panel unfolding limiting means comprises strap means extending tight from upper ends of pairs of opposite panels when in said unfolded position thereof.

27. A cargo container as defined in claim 3, wherein said vessel is provided with a liquid loading and unloading pipe means.

28. A cargo container as defined in claim 3, wherein said vessel is provided with a vent opening.

29. A cargo container as defined in claim 28, wherein means are provided for varying a size of said vent opening and thus the air flow therethrough in order to control the rate of descent of said vessel top wall from said expanded position to said retracted position.

30. A cargo container as defined in claim 28, wherein an air blower is adapted to be connected to said vent opening for supplying air pressure in said vessel for raising said vessel top wall towards said expanded position.

31. A cargo container as defined in claim 3, wherein said vessel top wall is provided with a manhole.

32. A cargo container as defined in claim 3, wherein said vessel is provided with a heat exchanger for maintaining the liquids at substantially constant temperatures.

33. A cargo container as defined in claim 3, wherein anchor means are provided for securing the cargo container on a vehicle.

34. A cargo container as defined in claim 3, wherein said box-like housing comprises a rigid floor connecting lower ends of said rigid side walls, said vessel bottom wall underlying said box housing rigid floor.

* * * * *